US009945599B2

(12) United States Patent
Lee et al.

(10) Patent No.: US 9,945,599 B2
(45) Date of Patent: Apr. 17, 2018

(54) AIR CONDITIONER AND CONTROL METHOD THEREOF

(71) Applicant: SAMSUNG ELECTRONICS CO., LTD., Suwon-si, Gyeonggi-do (KR)

(72) Inventors: Suk Ho Lee, Suwon-si (KR); Il Yong Cho, Suwon-si (KR); Hyung Mo Koo, Suwon-si (KR); Chang Yong Lee, Suwon-si (KR); Joon Hwan Lee, Uiwang-si (KR); Byoung Guk Lim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 872 days.

(21) Appl. No.: 14/300,713

(22) Filed: Jun. 10, 2014

(65) Prior Publication Data

US 2015/0027144 A1 Jan. 29, 2015

(30) Foreign Application Priority Data

Jul. 29, 2013 (KR) ..... 10-2013-0089353

(51) Int. Cl.
*F25D 21/06* (2006.01)
*F25B 49/00* (2006.01)
(Continued)

(52) U.S. Cl.
CPC ..... *F25D 21/006* (2013.01); *F24D 15/04* (2013.01); *F24D 19/1087* (2013.01);
(Continued)

(58) Field of Classification Search
CPC ..... F24D 15/04; F24D 2200/123; F24F 2011/0089; F25D 21/02; F25D 2600/06
(Continued)

(56) References Cited

U.S. PATENT DOCUMENTS 4,474,024 A * 10/1984 Eplett ..... F25D 21/02 62/140
4,573,326 A * 3/1986 Sulfstede ..... F25D 21/006 62/128

(Continued)

FOREIGN PATENT DOCUMENTS

EP 0364238 A2 4/1990
JP 2910849 6/1999
JP H 112 11186 * 11/1999

OTHER PUBLICATIONS

Extended European Search Report dated Jan. 14, 2015 in corresponding European Patent Application No. 14178409.0.
European Office Action dated Jul. 11, 2017 in related European Application No. 14 178 409.0.

*Primary Examiner* — Henry Crenshaw
(74) *Attorney, Agent, or Firm* — Staas & Halsey LLP

(57) ABSTRACT

An air conditioner, having an outdoor unit and an indoor unit, to perform a heating operation and a defrosting operation, the air conditioner including a detection unit to detect a state of at least one selected between the outdoor unit and the indoor unit and to output the detected value, a controller to determine whether the air conditioner is in a stable state when the defrosting operation is completed and, upon determining that the air conditioner is in the stable state, to control the detected value output from the detection unit to determine entry time of the next defrosting operation, and a storage unit to store a value detected in the stable state. The entry time of the defrosting operation is accurately determined, thereby minimizing the number of times of the defrosting operation during the heating operation.

13 Claims, 13 Drawing Sheets

(51) Int. Cl.

| | |
|---|---|
| ***F25D 21/00*** | (2006.01) |
| ***F24D 15/04*** | (2006.01) |
| ***F24D 19/10*** | (2006.01) |
| ***F25D 21/02*** | (2006.01) |
| ***F24F 11/00*** | (2018.01) |
| ***F25B 47/02*** | (2006.01) |

(52) U.S. Cl.
CPC ..... *F24F 11/0086* (2013.01); *F25B 47/025* (2013.01); *F25D 21/02* (2013.01); *F24D 2200/123* (2013.01); *F24F 2011/0089* (2013.01); *F25B 2313/0233* (2013.01); *F25B 2313/0292* (2013.01); *F25B 2313/0293* (2013.01); *F25B 2313/0294* (2013.01); *F25B 2600/2513* (2013.01); *F25B 2700/2106* (2013.01); *F25D 2600/06* (2013.01)

(58) Field of Classification Search
USPC ..... 62/154, 155, 156, 176.5
See application file for complete search history.

(56) References Cited

U.S. PATENT DOCUMENTS

| | | | | | |
|---|---|---|---|---|---|
| 4,850,204 | A * | 7/1989 | Bos | F25B 47/025 | 62/155 |
| 5,201,185 | A | 4/1993 | Hanson et al. | | |
| 5,319,943 | A | 6/1994 | Bahel et al. | | |
| 5,499,511 | A * | 3/1996 | Hara | B60H 1/00828 | 62/180 |
| 6,047,554 | A * | 4/2000 | Choi | F25D 21/006 | 62/154 |
| 6,142,219 | A * | 11/2000 | Korenic | F28C 1/14 | 165/110 |
| 2005/0155370 | A1* | 7/2005 | King | F25D 29/00 | 62/228.1 |
| 2005/0210897 | A1* | 9/2005 | Oomura | B60H 1/3216 | 62/186 |
| 2005/0268628 | A1* | 12/2005 | Thompson | F25B 30/02 | 62/176.5 |
| 2007/0144187 | A1* | 6/2007 | Lee | F25B 47/025 | 62/155 |
| 2009/0092501 | A1* | 4/2009 | Seibel | F04B 35/04 | 417/44.1 |

* cited by examiner

AIR CONDITIONER AND CONTROL METHOD THEREOF

CROSS-REFERENCE TO RELATED APPLICATIONS

This application claims the benefit of Korean Patent Application No. 10-2013-0089353, filed on Jul. 29, 2013 in the Korean Intellectual Property Office, the disclosure of which is incorporated herein by reference.

BACKGROUND

1. Field

Embodiments of the present disclosure relate to an air conditioner to control a defrosting operation and a control method thereof.

2. Description of the Related Art

An air conditioner is a device that cools, heats, or purifies and discharges suctioned air using movement of heat generated during evaporation and condensation of refrigerant to condition air in an interior space.

In summer, the air conditioner performs a cooling operation to discharge heat out of a room. In winter, the air conditioner performs a heating operation of a heat pump to supply heat into the room by circulating refrigerant in reverse order of a cooling cycle.

When the air conditioner performs the heating operation, an outdoor heat exchanger of an outdoor unit absorbs heat as the result of evaporation. At this time, the surface temperature of the outdoor heat exchanger is greatly reduced with the result that condensed water is formed on the surface of the outdoor heat exchanger.

When the temperature of the outdoor heat exchanger is 0° C. or less, the condensed water does not fall down the outdoor heat exchanger but is frozen on the surface of the outdoor heat exchanger.

The condensed water frozen on the surface of the outdoor heat exchanger reduces a heat exchange area of the outdoor heat exchanger. As a result, heat exchange performance of the outdoor heat exchanger is reduced. In addition, heating efficiency of the air conditioner and reliability of a compressor are deteriorated.

For this reason, the air conditioner performs a defrosting operation, in which the refrigerant is circulated as in the cooling operation, to defrost the outdoor heat exchanger.

That is, when the cooling operation is performed during the heating operation, the refrigerant in the outdoor heat exchanger is condensed with the result that the refrigerant radiates heat, which defrosts the outdoor heat exchanger.

In the defrosting operation, however, the refrigerant flows in the same direction as in the cooling operation during the heating operation. Consequently, two-phase refrigerant, which is not overcooled, passes through an expansion valve of an indoor unit with a result that noise is generated.

In addition, the air conditioner uses change in temperature of the outdoor heat exchanger to determine entry time of the defrosting operation. When outdoor temperature is low, lowering of evaporation pressure for heat exchange between the outdoor heat exchanger and outdoor air may not be differentiated from lowering of evaporation pressure due to frost on the outdoor heat exchanger with the result that the entry time of the defrosting operation may not be accurately determined.

Consequently, the defrosting operation may be frequently performed even when the outdoor heat exchanger is unfrosted or the defrosting operation may be performed in a state in which the outdoor heat exchanger is excessively frosted. In the latter case, the outdoor heat exchanger may not be sufficiently defrosted.

SUMMARY

It is an aspect of the present disclosure to provide an air conditioner that detects state information of the air conditioner in a stable state whenever a defrosting operation is completed, stores the detected value, and determines entry time of the next defrosting operation using the stored detected value and a control method thereof.

It is another aspect of the present disclosure to provide an air conditioner that, after a defrosting operation is completed, primarily determines entry time of the next defrosting operation using a value detected and stored in a stable state and, upon primarily determining that it is the entry time of the defrosting operation, secondarily determines the entry time of the next defrosting operation using at least one selected from between temperature of an outdoor heat exchanger and an operation time of a compressor and a control method thereof.

It is a further aspect of the present disclosure to provide an air conditioner, having a plurality of indoor units, which determines that the air conditioner is in a stable state when an operation rate of a compressor is equal to or greater than a predetermined operation rate and determines entry time of the next defrosting operation using a value detected and stored in the stable state and a control method thereof.

Additional aspects of the disclosure will be set forth in part in the description which follows and, in part, will be from the description, or may be learned by practice of the disclosure.

In accordance with an aspect of the present disclosure, a control method of an air conditioner, having an outdoor unit and at least one indoor unit, to perform a heating operation and a defrosting operation includes determining entry time of the defrosting operation during the heating operation, upon determining that it is the entry time of the defrosting operation, performing the defrosting operation, upon determining that the defrosting operation has been completed, determining a stable state of the air conditioner, upon determining that the air conditioner is in the stable state, detecting a state of at least one selected between the outdoor unit and the indoor unit, and storing a value detected in the stable state as a stable value to determine entry time of a next defrosting operation.

The determining the entry time of the defrosting operation may include detecting a state of at least one selected between the outdoor unit and the indoor unit during the heating operation, comparing the detected value with a stable value prestored in a storage unit to calculate a difference value therebetween, comparing the calculated difference value with a reference value to determine whether the difference value is equal to or greater than the reference value, and, upon determining that the difference value is equal to or greater than the reference value, determining that it is the entry time of the defrosting operation.

The determining the stable state may include determining the stable state within a predetermined time from start of the heating operation immediately after completion of the defrosting operation.

The determining the stable state may include checking an operation rate of a compressor provided at the outdoor unit, determining whether the checked operation rate of the compressor is equal to or greater than a predetermined operation rate, and, upon determining that the operation rate of the compressor is equal to or greater than the predetermined operation rate, determining that the air conditioner is in the stable state.

The determining the stable state may include checking a number of rotations of an outdoor fan provided at the outdoor unit, determining whether the checked number of rotations is equal to or greater than a predetermined number of rotations, and, upon determining that the checked number of rotations is equal to or greater than the predetermined number of rotations, determining that the air conditioner is in the stable state.

The detected value may include at least one selected from among a temperature value of an outdoor heat exchanger provided at the outdoor unit, a current value applied to a motor of an outdoor fan, a difference value in air pressure between an inlet and an outlet of the outdoor fan, a temperature value of an indoor heat exchanger provided at the indoor unit, an evaporation pressure value, and a condensation pressure value.

The control method may further include, when the value detected in the stable state is input, further storing the input detected value as a stable value.

The control method may further include, when the value detected in the stable state is input, deleting an earliest one of stable values prestored in a storage unit and storing the input detected value in the storage unit as a stable value.

The determining the entry time of the defrosting operation may include extracting a plurality of latest stored stable values from a present time from the storage unit, calculating an average value of the extracted stable values, comparing the value detected at the present time with the calculated average value to calculate a difference value therebetween, and comparing the calculated difference value with a reference value to determine whether the difference value is equal to or greater than the reference value.

The determining the entry time of the defrosting operation may include extracting a plurality of latest stored stable values from a present time from the storage unit, applying weight to the extracted stable values such that largest weight is applied to a latest one of the extracted stable values while smallest weight is applied to an earliest one of the extracted stable values to calculate a weighted average value, comparing the value detected at the present time with the calculated weighted average value to calculate a difference value therebetween, and comparing the calculated difference value with a reference value to determine whether the difference value is equal to or greater than the reference value.

The control method may further include, upon primarily determining that it is the entry time of the defrosting operation based on the stored stable value, detecting temperature of an outdoor heat exchanger provided at the outdoor unit and comparing the detected temperature of the outdoor heat exchanger with a predetermined temperature, checking an operation time of a compressor provided at the outdoor unit and comparing the checked operation time of a compressor with a predetermined operation time, and, when at least one selected from between a condition that the temperature of the outdoor heat exchanger is equal to or less than the predetermined temperature and a condition that the operation time of a compressor is equal to or greater than the predetermined operation time is satisfied, secondarily determining that it is the entry time of the defrosting operation.

The control method may further include, upon primarily determining that it is the entry time of the defrosting operation based on the stored stable value, comparing pressure of an outdoor heat exchanger provided at the outdoor unit with a predetermined pressure, and, upon determining that the pressure of the outdoor heat exchanger is equal to or less than the predetermined pressure, secondarily determining that it is the entry time of the defrosting operation.

The control method may further include checking an operation time of a compressor provided at the outdoor unit and forcibly controlling the defrosting operation when the checked operation time is equal to or greater than a predetermined forced defrosting time.

The control method may further include checking temperature of an outdoor heat exchanger provided at the outdoor unit and forcibly controlling the defrosting operation when the checked temperature is a predetermined forced defrosting temperature.

In accordance with another aspect of the present disclosure, an air conditioner, having an outdoor unit and at least one indoor unit, to perform a heating operation and a defrosting operation includes a detection unit to detect a state of at least one selected between the outdoor unit and the indoor unit, a storage unit to store a value detected in a stable state as a stable value, and a controller to determine whether the air conditioner is in the stable state during the heating operation, upon determining that the air conditioner is in the stable state, to control the value detected by the detection unit to be stored as a stable value, to compare a value detected at a present time with the stable value stored in the storage unit to calculate a difference value therebetween, and to compare the calculated difference value with a reference value to determine whether it is the entry time of the defrosting operation.

The controller may determine the stable state within a predetermined time from start of the heating operation immediately after completion of the defrosting operation.

The detected value may include at least one selected from among a temperature value of an outdoor heat exchanger provided at the outdoor unit, a current value applied to a motor of an outdoor fan, a difference value in air pressure between an inlet and an outlet of the outdoor fan, a temperature value of an indoor heat exchanger provided at the indoor unit, an evaporation pressure value, and a condensation pressure value.

When the detected value is the temperature value of the outdoor heat exchanger, the controller may determine that the air conditioner is in the stable state when the temperature of the outdoor heat exchanger fluctuates within a predetermined temperature range for a predetermined detection time after the heating operation is performed.

When the detected value is the temperature value of the indoor heat exchanger, the controller may determine that the air conditioner is in the stable state when the temperature of the indoor heat exchanger fluctuates within a predetermined temperature range for a predetermined detection time after the heating operation is performed.

When the detected value is the condensation pressure value, the controller may determine that the air conditioner is in the stable state when the condensation pressure fluctuates within a predetermined pressure range for a predetermined detection time after the heating operation is performed.

When the detected value is the evaporation pressure value, the controller may determine that the air conditioner is in the stable state when the evaporation pressure fluctuates within a predetermined pressure range for a predetermined detection time after the heating operation is performed.

The controller may determine whether an operation rate of a compressor is equal to or greater than a predetermined operation rate during the heating operation and, when the operation rate of the compressor is equal to or greater than the predetermined operation rate, determine that the air conditioner is in the stable state and control the value detected by the detection unit to be stored as a stable value.

The controller may check a number of rotations of an outdoor fan provided at the outdoor unit during the heating operation and, when the checked number of rotations is equal to or greater than a predetermined number of rotations, determine that the air conditioner is in the stable state and control the value detected by the detection unit to be stored as a stable value.

The stable state may include a state in which an outdoor heat exchanger provided at the outdoor unit is unfrosted.

The storage unit may store a value detected in a previous stable state and further store a value detected in a present stable state.

When a value detected in a present stable state is input, the storage unit may delete a prestored stable value and store the value detected in the present stable state as a stable value.

When a value detected in a present stable state is input, the storage unit may delete an earliest one of prestored stable values and store the value detected in the present stable state as a renewed stable value.

The controller may extract a plurality of latest stored detected values from a present time from the storage unit, calculate an average value of the extracted detected values, and compare the value detected at the present time with the calculated average value to determine the entry time of the defrosting operation.

The controller may apply the largest weight to a latest detected one of the detected values extracted from the storage unit and the smallest weight to an earliest one of the detected values extracted from the storage unit to calculate a weighted average value and compare the value detected at the present time with the calculated weighted average value to determine the entry time of the defrosting operation.

Upon primarily determining that it is the entry time of the defrosting operation based on the stored stable value, the controller may secondarily determine whether it is the entry time of the defrosting operation based on at least one selected from among temperature of an outdoor heat exchanger provided at the outdoor unit, pressure of the outdoor heat exchanger, and an operation time of a compressor provided at the outdoor unit.

The controller may further determine forced entry time of the defrosting operation using at least one selected from among the temperature of the outdoor heat exchanger, the pressure of the outdoor heat exchanger, and the operation time of the compressor and control the defrosting operation based on the further determined result.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
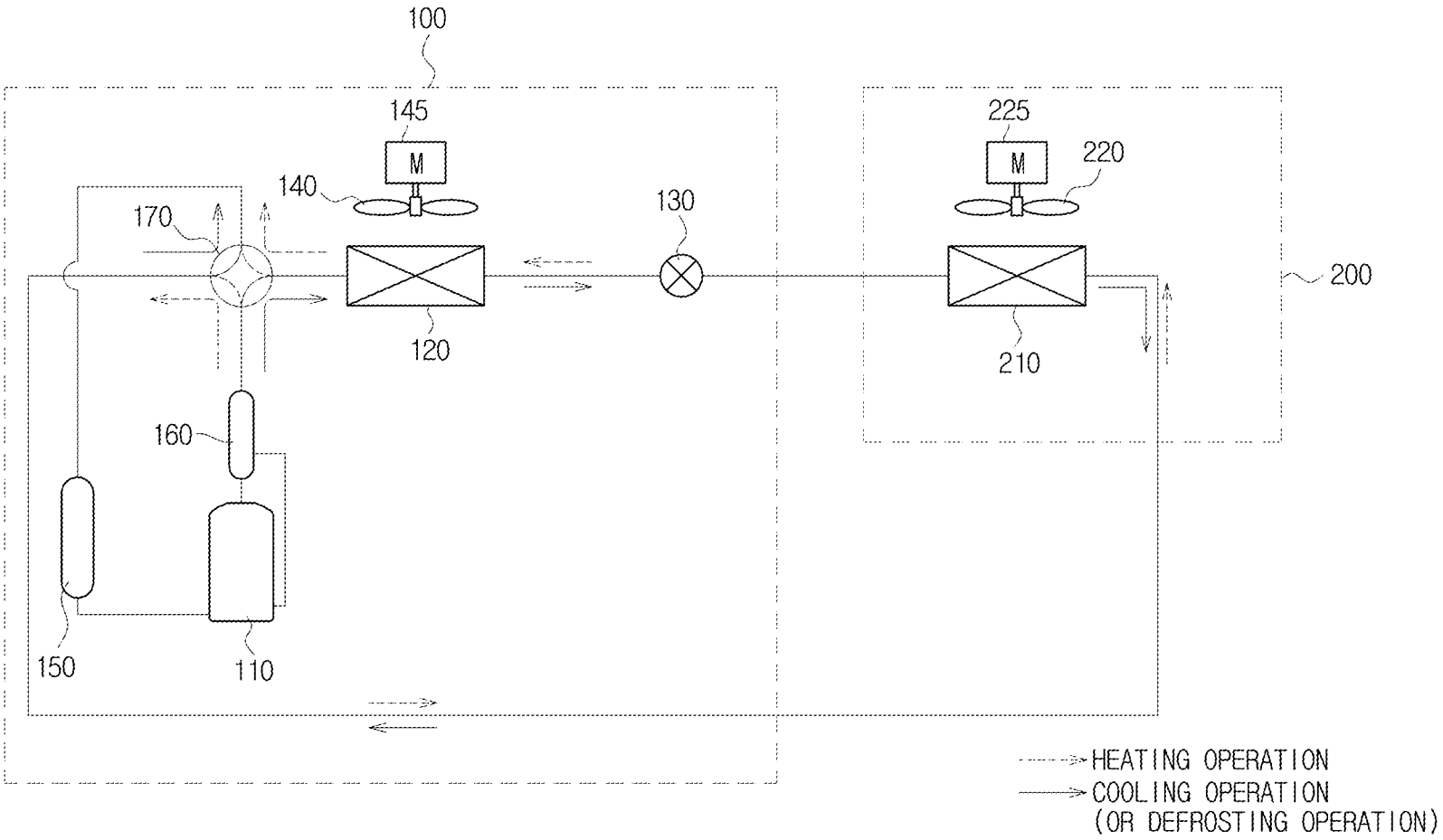
FIG. 1 is a view showing construction of an air conditioner according to an embodiment of the present disclosure.

Reference will now be made in detail to the embodiments of the present disclosure, examples of which are illustrated in the accompanying drawings, wherein like reference numerals refer to like elements throughout.

FIG. 1 is a view showing construction of an air conditioner according to an embodiment of the present disclosure. In this embodiment, the air conditioner is a single air conditioner.

The single air conditioner may perform both a cooling operation to cool a room and a heating operation to heat the room. In this embodiment, the single air conditioner performing the cooling operation and the heating operation is described by way of example.

The single air conditioner includes an outdoor unit 100 and an indoor unit 200.

The outdoor unit 100 includes a compressor 110, an outdoor heat exchanger 120, an expansion valve 130, an outdoor fan 140 driven by a motor 145, an accumulator 150, an oil separator 160, and a four-way valve 170. The indoor unit 200 includes an indoor heat exchanger 210 and an indoor fan 220 driven by a motor 225.

Operation of the respective loads when the air conditioner performs the cooling operation or a defrosting operation will be described.

The compressor 110 compresses refrigerant and discharges the compressed refrigerant, i.e. high-temperature, high-pressure gaseous refrigerant, into the outdoor heat exchanger 120.

The outdoor heat exchanger 120 is connected to a discharge port of the compressor 110 via a refrigerant pipe. The outdoor heat exchanger 120 condenses the refrigerant introduced from the compressor 110 through heat radiation from the refrigerant. At this time, the high-temperature, high-pressure gaseous refrigerant is changed into high-temperature, high-pressure liquefied refrigerant.

The expansion valve 130 is disposed between the outdoor heat exchanger 120 and the indoor heat exchanger 210.

The expansion valve 130 reduces pressure and temperature of the refrigerant introduced from the outdoor heat exchanger 120 such that heat is easily absorbed due to evaporation of the refrigerant and transmits the refrigerant to the indoor heat exchanger 210.

That is, the refrigerant, having passed through the expansion valve 130, is changed from the high-temperature, high-pressure liquefied refrigerant to low-temperature, low-pressure liquefied refrigerant. A capillary tube may be used as the expansion valve 130.

The outdoor fan 140 is provided at one side of the outdoor heat exchanger 120. The outdoor fan 140 is rotated by a motor to accelerate heat radiation from the refrigerant.

The accumulator 150 is disposed at a suction side of the compressor 110. The accumulator 150 separates unevaporated liquefied refrigerant from the refrigerant moving from the indoor heat exchanger 210 to the compressor 110 to prevent the liquefied refrigerant from being transmitted to the compressor 110, thereby preventing damage to the compressor 110.

The oil separator 160 separates oil contained in steam of the refrigerant discharged from the compressor 110 and returns the separated oil to the compressor 110. The four-way valve 170 is disposed at the outlet side of the compressor 110 to switch flow direction of the refrigerant based on whether the operation of the air conditioner is the cooling operation or the heating operation.

During the cooling operation, the four-way valve 170 guides the high-temperature, high-pressure refrigerant discharged from the compressor 110 to the outdoor heat exchanger 120 and guides the low-temperature, low-pressure refrigerant from the indoor unit 200 to the accumulator 150. At this time, the outdoor heat exchanger 120 functions as a condenser and the indoor heat exchanger 210 functions as an evaporator.

The indoor heat exchanger 210 of the indoor unit 200 is disposed in an indoor space. The indoor heat exchanger 210 exchanges heat with indoor air through heat absorption caused by evaporation of the refrigerant introduced from the expansion valve 130. At this time, the low-temperature, low-pressure liquefied refrigerant is changed into low-temperature, low-pressure gaseous refrigerant.

The indoor fan 220 is disposed at one side of the indoor heat exchanger 210. The indoor fan 220 is rotated by a motor 225 to forcibly blow the heat-exchanged air into the indoor space.

Operation of the respective loads when the air conditioner performs the heating operation will be described.

The compressor 110 compresses refrigerant and discharges the compressed refrigerant, i.e. high-temperature, high-pressure gaseous refrigerant, into the indoor heat exchanger 210.

The outdoor heat exchanger 120 is disposed in an outdoor space. The outdoor heat exchanger 120 exchanges heat with outdoor air through heat absorption caused by evaporation of the refrigerant introduced from the expansion valve 130. At this time, low-temperature, low-pressure liquefied refrigerant is changed into low-temperature, low-pressure gaseous refrigerant.

The expansion valve 130 is disposed between the outdoor heat exchanger 120 and the indoor heat exchanger 210. The expansion valve 130 reduces pressure and temperature of the refrigerant introduced from the indoor heat exchanger 210 such that heat is easily absorbed due to evaporation of the refrigerant and transmits the refrigerant to the outdoor heat exchanger 120.

The outdoor fan 140 is provided at one side of the outdoor heat exchanger 120. The outdoor fan 140 is rotated by the motor 145 to accelerate heat absorption of the refrigerant.

The accumulator 150 is disposed at the suction side of the compressor 110. The accumulator 150 separates unevaporated liquefied refrigerant from the refrigerant moving from the outdoor heat exchanger 120 to the compressor 110 to prevent the liquefied refrigerant from being transmitted to the compressor 110, thereby preventing damage to the compressor 110.

During the heating operation, the four-way valve 170 guides the high-temperature, high-pressure refrigerant discharged from the compressor 110 to the indoor unit 200 and guides the low-temperature, low-pressure refrigerant from the outdoor heat exchanger 120 to the accumulator 150. At this time, the outdoor heat exchanger 120 functions as an evaporator and the indoor heat exchanger 210 functions as a condenser.

That is, the outdoor heat exchanger 120 and the indoor heat exchanger 210 have different functions based on whether the operation of the air conditioner is the cooling operation or the heating operation. During the same operation, the outdoor heat exchanger 120 and the indoor heat exchanger 210 perform different functions.

The indoor heat exchanger 210 is connected to the discharge port of the compressor 110 via a refrigerant pipe. The indoor heat exchanger 210 condenses the refrigerant introduced from the compressor 110 through heat radiation from the refrigerant. At this time, the high-temperature, high-pressure gaseous refrigerant is changed into high-temperature, high-pressure liquefied refrigerant.

The indoor fan 220 is disposed at one side of the indoor heat exchanger 210. The indoor fan 220 is rotated by the motor 225 to forcibly blow the heat-exchanged air into the indoor space.

A plurality of refrigerant pipes may be provided. The refrigerant pipes are connected between the compressor 110 and the outdoor heat exchanger 120, between the outdoor heat exchanger 120 and the expansion valve 130, between the expansion valve 130 and the indoor heat exchanger 210, and between the indoor heat exchanger 210 and the compressor 110.

The air conditioner further includes a user interface 230 provided at the indoor unit 200 to allow user input of a command and to output operation information.

The air conditioner further includes detection units 180 and 240 to detect states of the outdoor unit 100 and the indoor unit 200 and drive modules 190 and 250 to determine entry time of the defrosting operation using values detected by the detection units and to control the defrosting operation upon determining that it is the entry time of the defrosting operation.

The detection units include an outdoor information detection unit 180 provided at the outdoor unit to detect outdoor information and an indoor information detection unit 240 provided at the indoor unit to detect indoor information. The drive modules include an outdoor drive module 190 provided at the outdoor unit to drive an outdoor load a value detected by the outdoor information detection unit 180 and an indoor drive module 250 provided at the indoor unit to drive an indoor load a value detected by the indoor information detection unit 240. These components will be described in detail with reference to FIG. 2.

Figure 2:
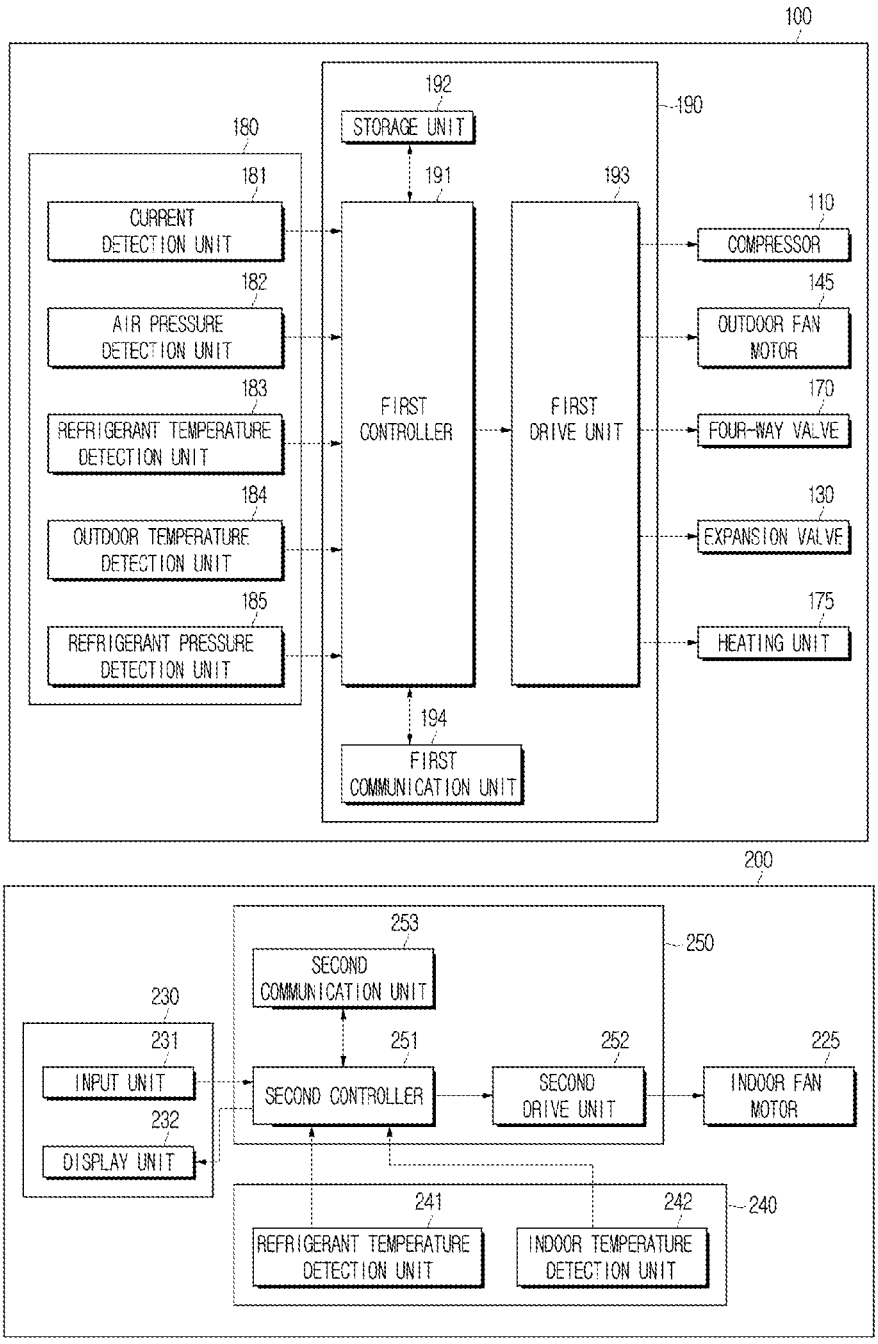
FIG. 2 is a control block diagram of the air conditioner according to the embodiment of the present disclosure.

FIG. 2 is a control block diagram of the air conditioner according to the embodiment of the present disclosure. The outdoor unit of the air conditioner includes an outdoor information detection unit 180, an outdoor drive module 190, and a plurality of outdoor loads 110, 130, and 140. The indoor unit includes a user interface 230, an indoor information detection unit 240, an indoor drive module 250, and an indoor load, which is the indoor fan 220 rotated by the motor 225.

The outdoor information detection unit 180 detects a state of at least one of the outdoor loads.

The outdoor information detection unit 180 includes a current detection unit 181 to detect current flowing in a motor 145 of the outdoor fan 140.

The outdoor information detection unit 180 may further include an air pressure detection unit 182 to detect the pressure of air input into and output from the outdoor fan, a refrigerant temperature detection unit 183 to detect the temperature of the refrigerant, an outdoor temperature detection unit 184 to detect outdoor temperature, and a refrigerant pressure detection unit 185 to detect the pressure of the refrigerant.

The air pressure detection unit 182 may include a first air pressure detection unit to detect the pressure of air input into the outdoor fan and a second air pressure detection unit to detect the pressure of air output from the outdoor fan.

The refrigerant temperature detection unit 183 is provided at the outdoor heat exchanger to detect the temperature of the outdoor heat exchanger. The refrigerant temperature detection unit 183 may be disposed at the inlet, the middle, or the outlet of the outdoor heat exchanger.

The refrigerant pressure detection unit 185 detects at least one selected from between evaporation pressure and condensation pressure of the refrigerant. The refrigerant pressure detection unit 185 may include a first refrigerant pressure detection unit provided at the suction port of the compressor to detect the pressure of the refrigerant suctioned into the compressor and a second refrigerant pressure detection unit provided at the discharge port of the compressor to detect the pressure of the refrigerant discharged from the compressor.

The first refrigerant pressure detection unit may be provided at the outlet side of the outdoor heat exchanger to detect the pressure of the refrigerant output from the outdoor heat exchanger. The second refrigerant pressure detection unit may be provided at the inlet side of the indoor heat exchanger to detect the pressure of the refrigerant input into the indoor heat exchanger.

The outdoor drive module 190 drives the outdoor loads including the compressor 110, the expansion valve 130, and the outdoor fan motor 145 to perform at least one selected from among the cooling operation, the heating operation, and the defrosting operation. The outdoor drive module 190 includes a first controller 191, a storage unit 192, a first drive unit 193, and a first communication unit 194.

When an operation command from the indoor unit is input, the first controller 191 controls driving of the respective loads in the outdoor unit.

When an operation start command is input, the first controller 191 checks an operation mode and controls opening of the flow channel of the four-way valve 170 based on the checked operation mode.

When a cooling operation command is input, the first controller 191 controls opening of the flow channel of the four-way valve 170 to circulate the refrigerant and controls the compressor 110, the expansion valve 130, and the outdoor fan motor 145 such that the indoor space is cooled.

When a heating operation command is input, the first controller 191 controls switching of the flow channel of the four-way valve 170 to switch the flow of the refrigerant and controls the compressor 110, the expansion valve 130, and the outdoor fan motor 145 such that the indoor space is heated.

In order to determine entry time of a defrosting operation during the heating operation, the first controller 191 detects a stable value in a stable state, determines entry time of the defrosting operation based on the stable value, controls switching of the flow channel of the four-way valve 170 such that the refrigerant circulation direction is changed upon determining that it is the entry time of the defrosting operation, and controls the compressor 110, the expansion valve 130, and the outdoor fan motor 145 such that the defrosting operation is performed.

In addition, the first controller 191 controls the refrigerant circulation direction during the defrosting operation such that the refrigerant circulation direction during the defrosting operation is equal to that during the cooling operation.

The outdoor unit further includes a heating unit 175 disposed adjacent to the outdoor heat exchanger. The first controller 191 may control driving of the heating unit 175 for the defrosting operation.

The entry time of the defrosting operation may be determined using one of the following control methods.

(1) During an initial heating operation or during a heating operation in a state in which a stable value is not stored in the storage unit, the entry time of the defrosting operation is determined based on at least one selected from among temperature of the outdoor heat exchanger, pressure of the outdoor heat exchanger, and operation time of the compressor.

In addition, a difference value between a stable value detected and stored before the initial heating operation and a value detected at the present time may be calculated and the entry time of the defrosting operation may be determined based on the calculated difference value.

(2) During a heating operation in a state in which a stable value is stored, a difference value between a stable value detected and stored in a stable state and a value detected at the present time is calculated and the entry time of the defrosting operation is determined based on the calculated difference value.

(3) During a heating operation in a state in which a stable value is stored, a difference value between a stable value detected and stored in a stable state and a value detected at the present time is calculated and the entry time of the defrosting operation is primarily determined based on the calculated difference value. Upon primarily determining that it is the entry time of the defrosting operation, the entry time of the defrosting operation is secondarily determined based on at least one selected from among temperature of the outdoor heat exchanger, pressure of the outdoor heat exchanger, and operation time of the compressor.

(4) During a heating operation in a state in which a stable value is stored, a predetermined number of stable values, detected and stored in a stable state, nearest the present time are extracted to calculate an average value, a difference value between the calculated average value and a value detected at the present time is calculated, and the entry time of the defrosting operation is determined based on the calculated difference value. The predetermined number may be 2 to 5.

Upon determining that it is the entry time of the defrosting operation, the entry time of the defrosting operation may be finally determined based on at least one selected from among temperature of the outdoor heat exchanger, pressure of the outdoor heat exchanger, and operation time of the compressor.

(5) During a heating operation in a state in which a stable value is stored, a predetermined number of stable values, detected and stored in a stable state, nearest the present time are extracted, the largest weight is given to the latest one of the extracted stable values while the smallest weight is given to the earliest one of the extracted stable values to calculate a weighted average value, a difference value between the calculated weighted average value and a value detected at the present time is calculated, and the entry time of the defrosting operation is determined based on the calculated difference value.

(6) When temperature of the outdoor heat exchanger is equal to or less than a predetermined forced defrosting temperature, pressure of the outdoor heat exchanger is equal to or less than a predetermined forced defrosting pressure, or operation time of the compressor is equal to or greater than a predetermined forced defrosting time, it is determined that it is the entry time of the defrosting operation.

The operation time of the compressor is operation time of the compressor during the heating operation. The operation time of the compressor is operation time of the compressor accumulated after the defrosting operation is completed.

The first controller 191 determines whether the defrosting operation has been completed. Upon determining that the defrosting operation has been completed, the first controller 191 controls switching of the flow channel of the four-way valve 170 and controls the compressor 110, the expansion valve 130, and the outdoor fan 140 such that the heating operation is resumed.

The controller 191 determines whether the air conditioner is in a stable state within a predetermined time after the defrosting operation is completed and stores the value detected by the detection unit as a stable value to determine entry time of the next defrosting operation.

In addition, before an initial heating operation is performed, the controller 191 may store the value detected by the detection unit as a stable value to determine entry time of an initial defrosting operation.

The value stored as the stable value may be at least one selected from among a current value of the motor of the outdoor fan, a temperature value of the refrigerant at the inlet of the outdoor heat exchanger, a temperature value of the refrigerant at the outlet of the outdoor heat exchanger, a condensation pressure value, an evaporation pressure value, a difference value in air pressure between the inlet and the outlet of the outdoor fan, a temperature value of the refrigerant at the inlet of the indoor heat exchanger, and a temperature value of the refrigerant at the outlet of the indoor heat exchanger.

In a case in which the detected value is a temperature value, it may be determined that the air conditioner is in a stable state when a difference value for a predetermined detection time is less than about 10° C. In addition, in a case in which the detected value is a pressure value, it may be determined that the air conditioner is in the stable state when a difference value for a predetermined detection time is less than about 3 $kgf/cm^2$.

The predetermined detection time is about 1 minute or more.

Whenever the defrosting operation is completed, the storage unit 192 stores the value detected in the stable state after the defrosting operation is completed as a stable value.

The storage unit 192 stores a predetermined operation time of the compressor, a predetermined temperature of the outdoor heat exchanger, and a predetermined pressure of the outdoor heat exchanger, which are used to secondarily determine the entry time of the defrosting operation.

The storage unit 192 stores forced defrosting time of the compressor and forced defrosting temperature of the outdoor heat exchanger, which are used to determine the entry time of the defrosting operation without considering the value detected in the stable state.

Meanwhile, the storage unit 192 may store defrosting completion temperature of the outdoor heat exchanger, which is used to determine completion of the defrosting operation.

In addition, the storage unit 192 may store defrosting operation time, which is used to determine completion of the defrosting operation.

The first drive unit 193 drives various loads provided at the outdoor unit according to a command of the first controller 191. The first drive unit 193 drives the compressor 110, opens and closes the expansion valve, drives the motor of the outdoor fan, and controls opening of the flow channel of the four-way valve 170.

The first drive unit 193 may drive the heating unit 175 during the defrosting operation.

The first communication unit 194 communicates with the indoor unit 200 to receive indoor information from the indoor unit and to transmit a predetermined temperature selected by a user to the first controller 191.

The user interface 230 allows user input of a command and outputs information of the air conditioner. The user interface 230 includes an input unit 231 and a display unit 232.

The input unit 231 allows the user to input information, such as operation on/off, an operation mode, and indoor temperature and transmits the information to the second controller 251.

The display unit 232 displays an operation mode, target temperature, current indoor temperature, etc.

The indoor information detection unit 240 detects a state of at least one of the indoor loads.

The indoor information detection unit 240 includes an indoor refrigerant temperature detection unit 241 to detect temperature of the indoor heat exchanger and an indoor temperature detection unit 242 to detect indoor temperature.

The indoor refrigerant temperature detection unit 241 detects temperature at the inlet, the middle, the outlet of the indoor heat exchanger 210.

The indoor drive module 250 includes a second controller 251, a second drive unit 252, and a second communication unit 253.

The second controller 251 controls operation of the indoor fan 220 and a blade (not shown) based on information input through the input unit 231 or the second communication unit 253 and controls transmission of the information input through the input unit 231 or the second communication unit 253 and indoor information detected by the indoor information detection unit 240.

The second controller 251 controls information regarding a mode selected by the user to be transmitted to the first controller 191 of the outdoor unit.

The second drive unit 252 drives various loads provided at the indoor unit according to a command of the second controller 251.

The second drive unit 252 includes a motor drive unit to drive a motor 225 of the indoor fan 220. The second drive unit 252 may further include a blade drive unit to drive the blade.

The second communication unit 253 transmits information input through the input unit 231 or a remote controller (not shown) and indoor information detected by the indoor information detection unit 240 to the first controller 191 according to a command of the second controller 251.

The remote controller may be a wired or wireless remote controller. The remote controller allows user input of an operation command and transmits the user input to the indoor unit 200.

Figure 3A:
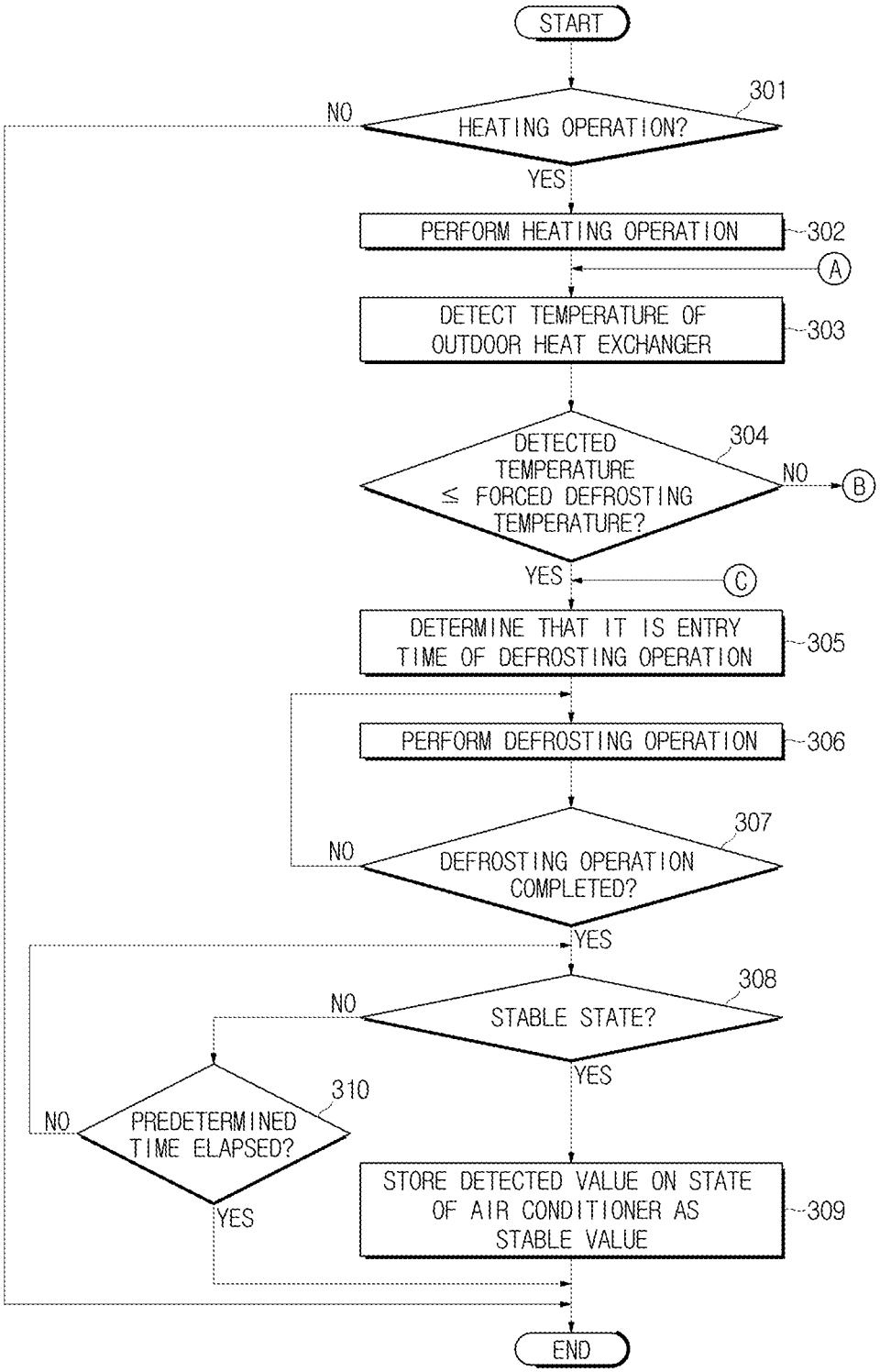
FIG. 3A and FIG. 3B are a flowchart showing an example of a control method of an air conditioner according to an embodiment of the present disclosure.
Figure 3B:
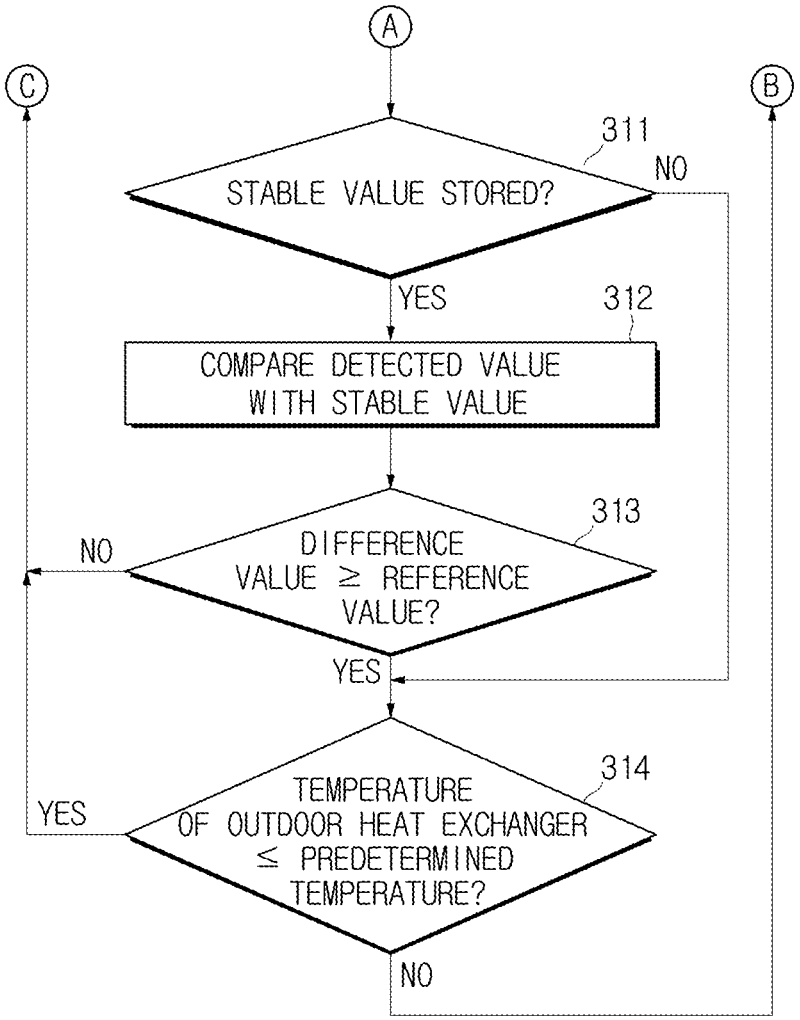

FIG. 3A and FIG. 3B are a control flowchart of the air conditioner according to the embodiment of the present disclosure. This is an example of control of the air conditioner.

The air conditioner determines whether an operation start command has been input through the input unit 231 of the indoor unit or the remote controller. Upon determining that the operation start command has been input, the air conditioner checks an input operation mode.

The air conditioner determines whether the checked operation mode is a heating operation (301). Upon determining that the checked operation mode is not the heating operation, the air conditioner drives the compressor 110 such that refrigerant compressed by the compressor 110 is discharged to the outdoor heat exchanger to perform a cooling operation.

On the other hand, upon determining that the checked operation mode is the heating operation, the air conditioner controls the flow channel of the four-way valve 170 and drives the compressor 110 such that the refrigerant compressed by the compressor 110 is discharged to the indoor heat exchanger to perform the heating operation (302) and detects temperature of the outdoor heat exchanger while performing the heating operation (303).

The temperature of the outdoor heat exchanger may be temperature at the inlet, the middle, or the outlet of the outdoor heat exchanger.

The air conditioner compares the detected temperature with prestored forced defrosting temperature to determine whether the detected temperature is equal to or less than the forced defrosting temperature (304). Upon determining that the detected temperature is equal to or less than the forced defrosting temperature, the air conditioner determines that it is entry time of a defrosting operation (305) and performs the defrosting operation (306).

That is, upon determining that it is entry time of the defrosting operation, the air conditioner switches the flow channel of the four-way valve 170 such that the refrigerant compressed by the compressor 110 is discharged to the indoor heat exchanger 210 to perform the defrosting operation.

Flow of the refrigerant during the defrosting operation is equal to that during the cooling operation.

As a result, high-temperature refrigerant flows in the outdoor heat exchanger and thus the outdoor heat exchanger may be defrosted.

In addition, the air conditioner may drive the heating unit disposed adjacent to the outdoor heat exchanger during the defrosting operation.

Subsequently, the air conditioner determines whether the defrosting operation has been completed (307).

Completion of the defrosting operation is determined based on temperature of the outdoor heat exchanger or defrosting operation time.

More specifically, the air conditioner detects temperature of the outdoor heat exchanger, determines whether the detected temperature of the outdoor heat exchanger is defrosting completion temperature, and determines that the defrosting operation has been completed upon determining that the detected temperature of the outdoor heat exchanger is the defrosting completion temperature.

In addition, when a predetermined defrosting operation time elapses, the air conditioner may determine that the defrosting operation has been completed.

Upon determining that the defrosting operation has been completed, the air conditioner determines whether the air conditioner is in a stable state (308). Upon determining that the air conditioner is in the stable state, the air conditioner detects a state of the air conditioner and stores the detected value as a stable value (309).

The air conditioner determines whether the air conditioner is in the stable state within a predetermined time from start of the heating operation after completion of the defrosting operation.

The heating operation after completion of the defrosting operation may be performed in a state in which the outdoor heat exchanger is defrosted.

Consequently, it may be designated as the stable state when a variation of a value detected by each detection unit of the air conditioner after a predetermined time from start of the heating operation is small such that a detected value of the outdoor heat exchanger in an unfrosted state is used as information to determine entry time of the next defrosting operation.

In this way, the unfrosted state may be designated as the stable state and entry time of the next defrosting operation may be determined using a value detected in the stable state, thereby preventing entry of the defrosting operation in the unfrosted state.

Meanwhile, outdoor temperatures differ depending upon environments in which the air conditioner is used. In addition, frosting speeds differ depending upon environments in which the air conditioner is installed. For these reasons, it may be difficult to determine entry time of the defrosting operation only based on outdoor temperature, temperature of the outdoor heat exchanger, and operation time of the compressor. In this case, it may be determined whether the air conditioner is in the stable state to determine entry time of the defrosting operation, thereby improving accuracy in determining entry time of the defrosting operation.

In addition, in a case in which a temperature value of the outdoor heat exchanger or the indoor heat exchanger is used to determine entry time of the defrosting operation instead of a current value of the motor of the outdoor fan, it may be determined that the air conditioner is in the stable state when a fluctuation value for a predetermined detection time is within a predetermined temperature range of less than about 10° C. In addition, in a case in which a pressure value of the compressor is used, it may be determined that the air conditioner is in the stable state when a fluctuation value for a predetermined detection time is within a predetermined temperature range of less than about 3 $kgf/cm^2$.

The air conditioner performs the heating operation and detects states of the respective loads using the detection units within a predetermined time from start of the heating operation.

In a case in which a temperature value of each is detected to determine the stable state, the temperature value may be detected when a fluctuation value for a predetermined detection time is within a predetermined temperature range of less than about 10° C. In a case in which a pressure value of each is detected, the pressure value may be detected when a fluctuation value for a predetermined detection time is within a predetermined temperature range of less than about 3 $kgf/cm^2$.

The loads include the compressor, the outdoor heat exchanger, the outer fan, and the indoor heat exchanger. The detection units include the current detection unit 181 to detect current flowing in the motor of the outdoor fan, the air pressure detection unit 182 to detect the pressure of air input into and output from the outdoor fan, the refrigerant temperature detection unit 183 to detect the temperature of the refrigerant at the inlet side or the outlet side of the outdoor heat exchanger, and the refrigerant pressure detection unit 185 to detect the pressure of the refrigerant at the suction side or the discharge side of the compressor.

That is, the stable value is at least one selected from among a current value of the motor of the outdoor fan, a temperature value of the refrigerant at the inlet of the outdoor heat exchanger, a temperature value of the refrigerant at the outlet of the outdoor heat exchanger, a condensation pressure value, an evaporation pressure value, a difference value in air pressure between the inlet and the outlet of the outdoor fan, a temperature value of the refrigerant at the inlet of the indoor heat exchanger, and a temperature value of the refrigerant at the outlet of the indoor heat exchanger.

The air conditioner determines whether the air conditioner is in the stable state within a predetermined time (310). Upon determining that a predetermined time to determine whether the air conditioner is in the stable state has elapsed, the air conditioner performs the heating operation without detection of a stable value. In this case, the air conditioner uses only the previous stable value to determine entry time of the next defrosting operation.

When the temperature value or the pressure value of the outdoor heat exchanger is greatly lowered as described above, entry of the defrosting operation may be performed without calculating a difference value from a value detected in the stable state, thereby minimizing a possibility that the defrosting operation may not be performed due to an error caused when the stable value in the stable state is acquired.

Upon determining that the detected temperature of the outdoor heat exchanger exceeds forced defrosting temperature, the air conditioner determines whether there is a stable value prestored in the storage unit 192 (311). Upon determining that the stable value is prestored in the storage unit 192, the air conditioner compares a value detected at the present time with the prestored stable value (312) to calculate a difference value and compares the calculated difference value with a predetermined reference value to determine whether the difference value is equal to or greater than the reference value (313), thereby primarily determining whether it is entry time of the defrosting operation.

The reference value may be a predetermined constant value or a predetermined proportion of the stable value.

Upon determining that the difference value is equal to or greater than the reference value, the air conditioner primarily determines that it is entry time of the defrosting operation. Subsequently, the air conditioner determines whether the temperature of the outdoor heat exchanger is equal to or less than a predetermined temperature (314) to secondarily determine whether it is entry time of the defrosting operation.

Upon secondarily determining that it is entry time of the defrosting operation, the air conditioner performs the defrosting operation. Processes after the defrosting operation correspond to processes 306 to 310.

The air conditioner updates the stable value stored in the storage unit 192.

In addition, the air conditioner may further store a stable value detect at the present time in the storage unit 192 of the outdoor unit in addition to a plurality of latest detected stable values.

In addition, upon determining that the heating operation to be performed at the present time is an initial heating operation, the air conditioner detects states of the respective loads provided at the air conditioner using the detection units and stores detected values as stable values. The stored stable values are used as information to determine entry time of the defrosting operation.

A process of checking entry time of the defrosting operation and determining whether it is the entry time of the defrosting operation will be described with reference to FIG. 4. A current value is used as the stable value.

Figure 4:
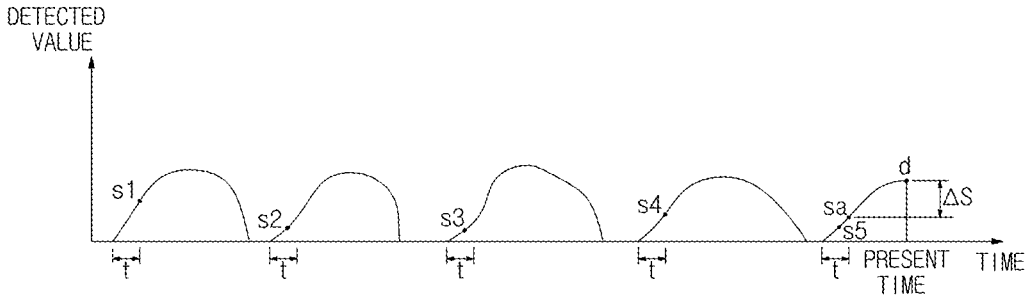
FIG. 4 is a view illustrating control of the air conditioner according to the embodiment of the present disclosure.

As shown in FIG. 4, the air conditioner determines whether the air conditioner is in the stable state within a predetermined time t from start of the heating operation after completion of the defrosting operation whenever the defrosting operation is completed and stores current values s1, s2, s3, s4, and s5 as stable values in the stable state. Only a predetermined number of latest detected current values from the present time may be stored.

That is, the air conditioner updates data stored in the storage unit 192.

For example, it is assumed that only three current values have been stored and a current value s5 has been detected.

When a current value s5 as a stable value has been detected in a state in which three current values s2, s3, and s4 have been prestored, the air conditioner deletes the earliest current value s2 and stores two latest detected current values s3 and s4 from the present time and the current value s5 detected at the present time. As a result, storage load of the storage unit 192 may be reduced.

In FIG. 4, the stable value is a current value applied to the motor of the outdoor fan. As the amount of frost formed in the outdoor heat exchanger increases during the heating operation, load applied to the motor of the outdoor fan increases with the result that current applied to the motor of the outdoor fan increases.

The air conditioner calculates a difference value Δs between a current value d at the present time and the current value s5 detected in the stable state and determines that it is entry time of the defrosting operation when the difference value is equal to or greater than the reference value.

In addition, the air conditioner may extract a predetermined number of latest detected stable values from the present time, calculate an average value of the extracted stable values, calculate a difference value between the calculated average value and a value detected at the present time, and determine entry time of the defrosting operation based on the calculated difference value.

For example, the air conditioner may determine entry time of the defrosting operation using three stable values, which will be described with reference to FIG. 4.

The air conditioner may extract three latest detected current values s3, s4, and s5 from the present time, calculate an average value sa of the extracted three current values s3, s4, and s5, calculate a difference value between the calculated average value sa and a current value d detected at the present time, compare the calculated difference value with the reference value, and determine that it is entry time of the defrosting operation when the difference value is equal to or greater than the reference value.

In addition, the air conditioner may apply a weight to the latest detected one of a plurality of stable values to calculate a weighted average value and determine the entry time of the defrosting operation based on the weighted average value.

That is, the air conditioner applies the largest weight to the latest detected one of a plurality of stable values and the smallest weight to the earliest one of the stable values to calculate a weighted average value, calculates a difference value between the calculated weighted average value and a value detected at the present time, and determines the entry time of the defrosting operation based on the calculated difference value.

Referring to FIG. 4, when determining entry time of the defrosting operation using three detected values, the air conditioner applies the largest weight to the latest detected stable value s5 and the smallest weight to the earliest stable value s3 to calculate a weighted average value, calculates a difference value between the calculated weighted average value and a value detected at the present time, and determines the entry time of the defrosting operation based on the calculated difference value.

Figure 5A:
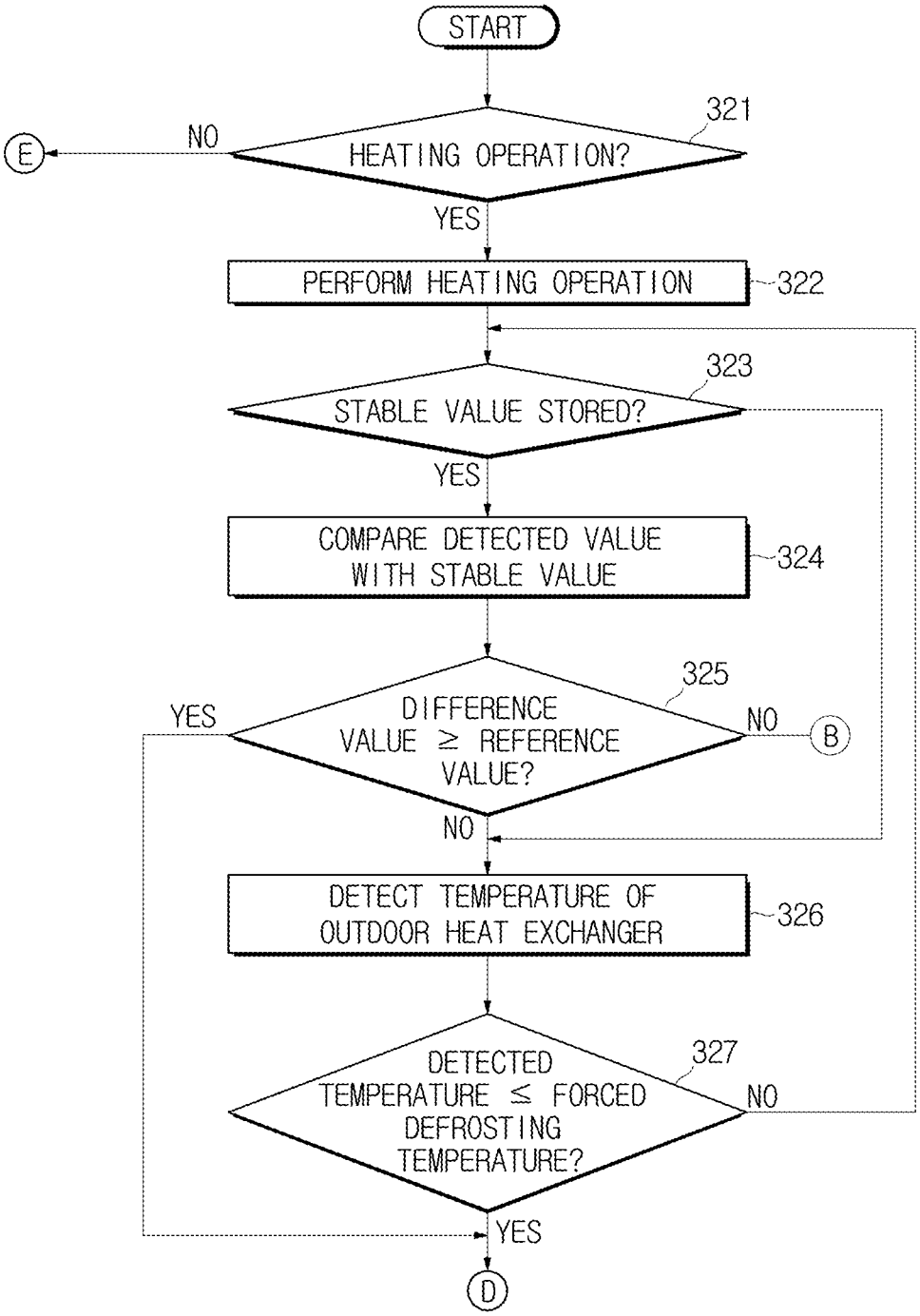
FIG. 5 A and FIG. 5B are a flowchart showing another example of the control method of the air conditioner according to the embodiment of the present disclosure.
Figure 5B:
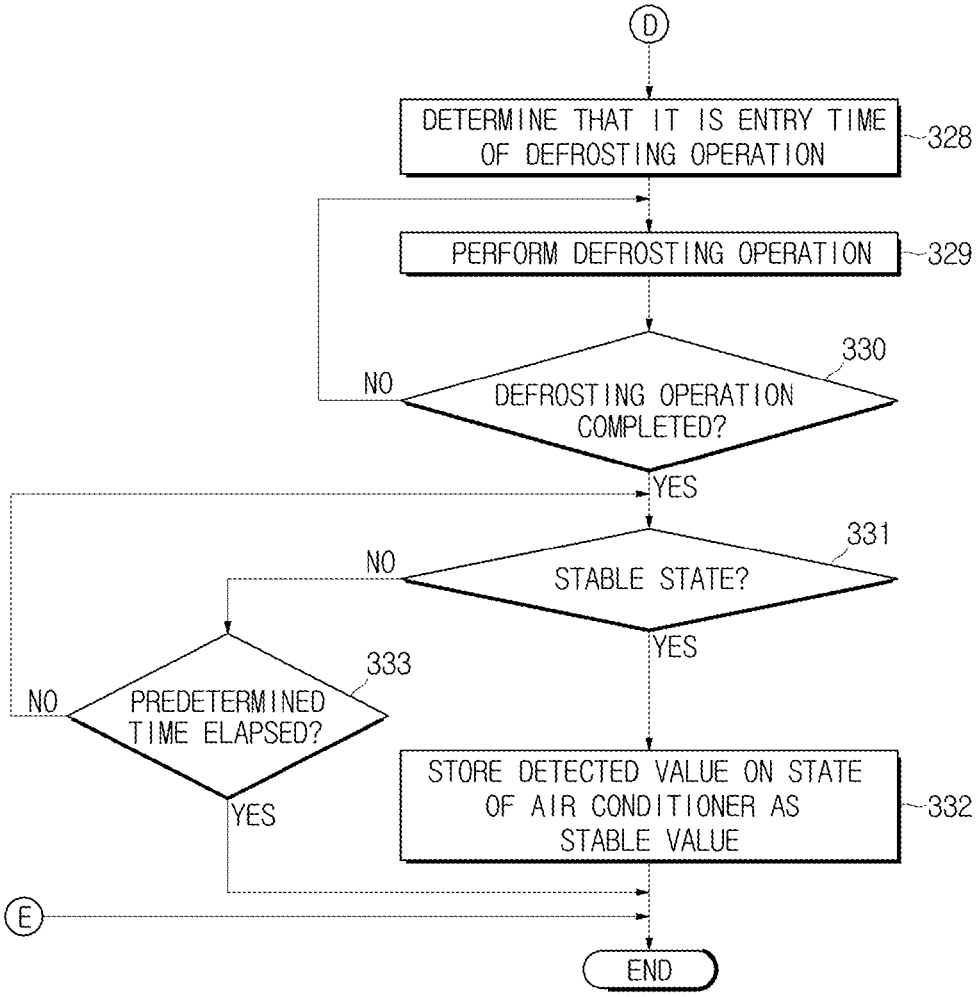

FIG. 5A and FIG. 5B are a control flowchart of the air conditioner according to the embodiment of the present disclosure. This is another example of control of the air conditioner.

The air conditioner determines whether an operation start command has been input through the input unit 231 of the indoor unit or the remote controller. Upon determining that the operation start command has been input, the air conditioner checks an input operation mode.

The air conditioner determines whether the checked operation mode is a heating operation (321). Upon determining that the checked operation mode is not the heating operation, the air conditioner drives the compressor 110 such that refrigerant compressed by the compressor 110 is discharged to the outdoor heat exchanger to perform a cooling operation.

On the other hand, upon determining that the checked operation mode is the heating operation, the air conditioner controls the flow channel of the four-way valve 170 and drives the compressor 110 such that the refrigerant compressed by the compressor 110 is discharged to the indoor heat exchanger to perform the heating operation (322).

The air conditioner determines whether there is a stable value prestored in the storage unit 192 (323). Upon determining that the stable value is prestored in the storage unit 192, the air conditioner compares a value detected at the present time with the prestored stable value (324) to calculate a difference value and compares the calculated difference value with a predetermined reference value to determine whether the difference value is equal to or greater than the reference value (325). Upon determining that the difference value is less than the reference value, the air conditioner detects temperature of the outdoor heat exchanger (326) and compares the detected temperature of the outdoor heat exchanger with forced defrosting temperature (327) to determine whether it is entry time of the defrosting operation (328).

The temperature of the outdoor heat exchanger may be temperature at the inlet, the middle, or the outlet of the outdoor heat exchanger.

On the other hand, upon determining that the difference value is equal to or greater than the reference value, the air conditioner determines that it is entry time of the defrosting operation (328).

Upon determining that it is entry time of the defrosting operation, the air conditioner performs the defrosting operation (329).

That is, upon determining that it is entry time of the defrosting operation, the air conditioner switches the flow channel of the four-way valve 170 such that the refrigerant compressed by the compressor 110 is discharged to the indoor heat exchanger 210 to perform the defrosting operation.

Flow of the refrigerant during the defrosting operation is equal to that during the cooling operation.

As a result, high-temperature refrigerant flows in the outdoor heat exchanger and thus the outdoor heat exchanger may be defrosted.

In addition, the air conditioner may drive the heating unit disposed adjacent to the outdoor heat exchanger during the defrosting operation.

Subsequently, the air conditioner determines whether the defrosting operation has been completed (330).

Completion of the defrosting operation is determined based on temperature of the outdoor heat exchanger or defrosting operation time.

Upon determining that the defrosting operation has been completed, the air conditioner determines whether the air conditioner is in a stable state (331). Upon determining that the air conditioner is in the stable state, the air conditioner detects a state of the air conditioner and stores the detected value as a stable value (332).

The air conditioner updates the stable value stored in the storage unit 192.

In addition, the air conditioner may further store a stable value detect at the present time in the storage unit 192 of the outdoor unit in addition to a plurality of latest detected stable values.

In addition, upon determining that the heating operation to be performed at the present time is an initial heating operation, the air conditioner detects states of the respective loads provided at the air conditioner using the detection units and stores detected values as stable values. The stored stable values are used as information to determine entry time of the defrosting operation.

Determination as to whether the air conditioner is in the stable state is the same as the previous example.

That is, the stable value is at least one selected from among a current value of the motor of the outdoor fan, a temperature value of the refrigerant at the inlet of the outdoor heat exchanger, a temperature value of the refrigerant at the outlet of the outdoor heat exchanger, a condensation pressure value, an evaporation pressure value, a difference value in air pressure between the inlet and the outlet of the outdoor fan, a temperature value of the refrigerant at the inlet of the indoor heat exchanger, and a temperature value of the refrigerant at the outlet of the indoor heat exchanger.

The air conditioner determines whether the air conditioner is in the stable state within a predetermined time (333). Upon determining that a predetermined time to determine whether the air conditioner is in the stable state has elapsed, the air conditioner performs the heating operation without detection of a stable value. In this case, the air conditioner uses only the previous stable value to determine entry time of the next defrosting operation.

Figure 6A:
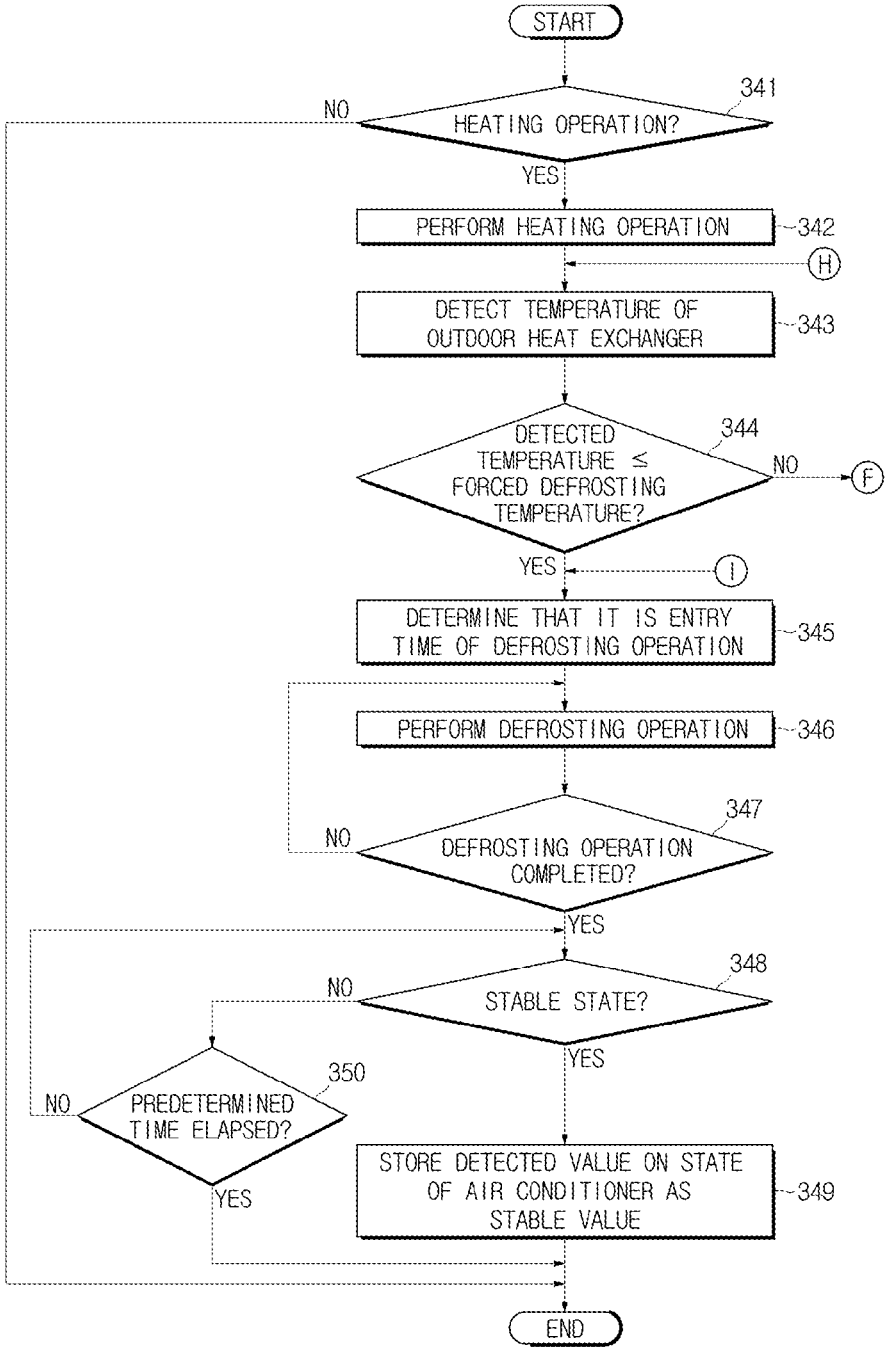
FIG. 6 A and FIG. 6B are a flowchart showing a further example of the control method of the air conditioner according to the embodiment of the present disclosure.
Figure 6B:
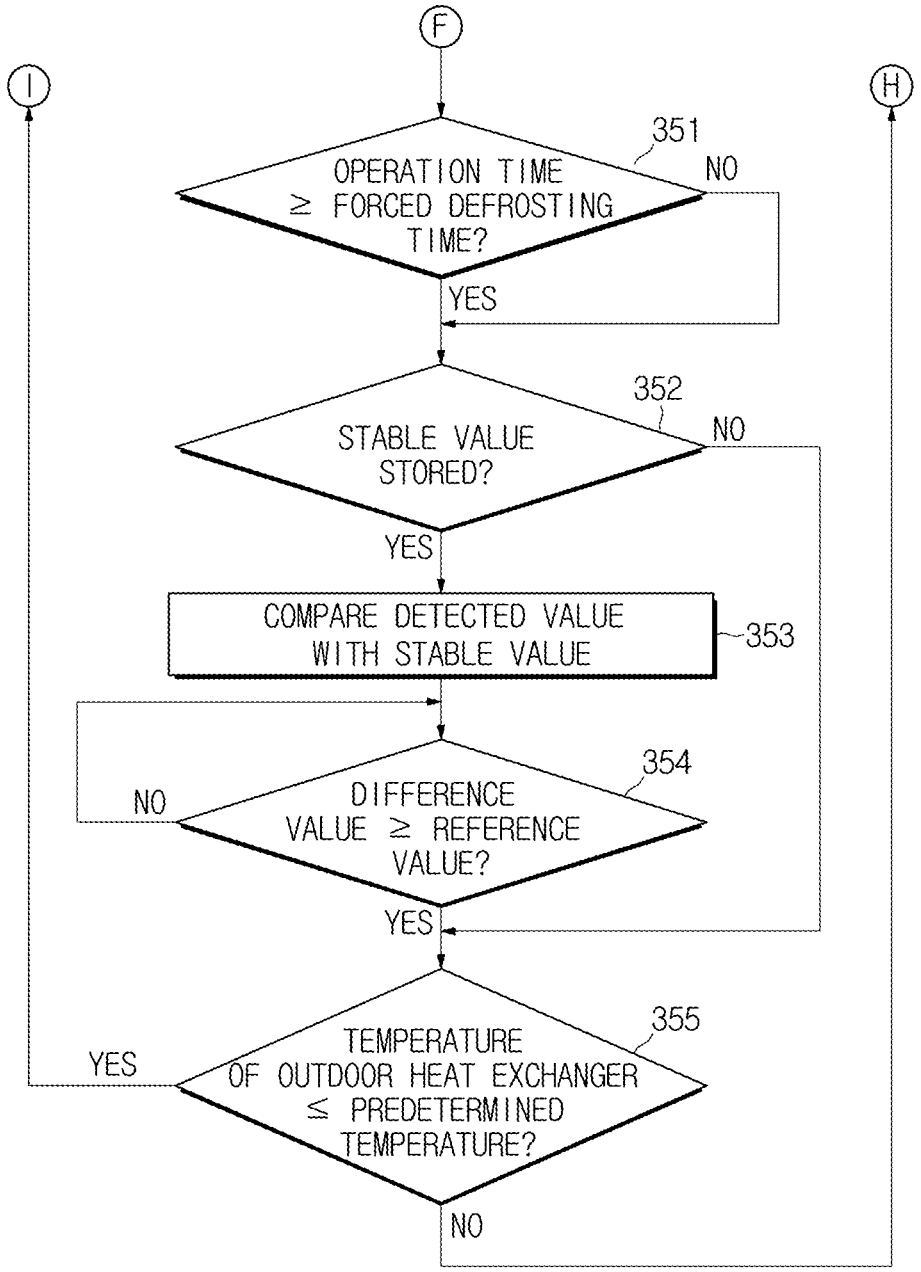

FIG. 6A and FIG. 6B are a control flowchart of the air conditioner according to the embodiment of the present disclosure. This is a further of control of the air conditioner.

The air conditioner determines whether an operation start command has been input through the input unit 231 of the indoor unit or the remote controller. Upon determining that the operation start command has been input, the air conditioner checks an input operation mode.

The air conditioner determines whether the checked operation mode is a heating operation (341). Upon determining that the checked operation mode is not the heating operation, the air conditioner drives the compressor 110 such that refrigerant compressed by the compressor 110 is discharged to the outdoor heat exchanger to perform a cooling operation.

On the other hand, upon determining that the checked operation mode is the heating operation, the air conditioner controls the flow channel of the four-way valve 170 and drives the compressor 110 such that the refrigerant compressed by the compressor 110 is discharged to the indoor heat exchanger to perform the heating operation (342).

During the heating operation, the air conditioner detects temperature of the outdoor heat exchanger (343).

The temperature of the outdoor heat exchanger may be temperature at the inlet, the middle, or the outlet of the outdoor heat exchanger.

The air conditioner compares the detected temperature with prestored forced defrosting temperature to determine whether the detected temperature is equal to or less than the forced defrosting temperature (344). Upon determining that the detected temperature is equal to or less than the forced defrosting temperature, the air conditioner determines that it is the entry time of the defrosting operation (345) and performs the defrosting operation (346).

Subsequently, the air conditioner determines whether the defrosting operation has been completed (347).

Upon determining that the defrosting operation has been completed, the air conditioner determines whether the air conditioner is in a stable state (348). Upon determining that the air conditioner is in the stable state, the air conditioner detects a state of the air conditioner and stores the detected value as a stable value (349).

That is, the air conditioner performs the heating operation and detects states of the respective loads using the detection units within a predetermined time from start of the heating operation and stores the detected value as a stable value, Determination as to whether the air conditioner is in the stable state is the same as the previous example and thus a description thereof will be omitted.

That is, the stable value is at least one selected from among a current value of the motor of the outdoor fan, a temperature value of the refrigerant at the inlet of the outdoor heat exchanger, a temperature value of the refrigerant at the outlet of the outdoor heat exchanger, a condensation pressure value, an evaporation pressure value, a difference value in air pressure between the inlet and the outlet of the outdoor fan, a temperature value of the refrigerant at the inlet of the indoor heat exchanger, and a temperature value of the refrigerant at the outlet of the indoor heat exchanger.

The air conditioner determines whether the air conditioner is in the stable state within a predetermined time (350). Upon determining that a predetermined time to determine whether the air conditioner is in the stable state has elapsed, the air conditioner performs the heating operation without detection of a stable value. In this case, the air conditioner uses only the previous stable value to determine entry time of the next defrosting operation.

Upon determining that the temperature of the outdoor heat exchanger exceeds the forced defrosting temperature as the result of comparison between the temperature of the outdoor heat exchanger and the forced defrosting temperature, the air conditioner compares operation time of the compressor with the forced defrosting temperature to determine whether the operation time of the compressor is equal to or greater than the forced defrosting temperature (351), thereby further determining the entry time of the forced defrosting operation.

The forced defrosting operation is a defrosting operation performed without checking a difference value from a value detected in the stable state to minimize a possibility that the defrosting operation may not be performed due to an error caused when the stable value in the stable state is acquired when the temperature value or the pressure value of the outdoor heat exchanger is greatly lowered or when the operation time of the compressor is equal to or greater than the forced defrosting temperature.

That is, upon determining that the operation time of the compressor is equal to or greater than the forced defrosting temperature even when the temperature of the outdoor heat exchanger exceeds the forced defrosting temperature, the air conditioner determines that it is entry time of the defrosting operation (345) and performs the defrosting operation (346).

In addition, upon determining that the temperature of the outdoor heat exchanger exceeds the forced defrosting temperature and the operation time of the compressor is less than the forced defrosting temperature, the air conditioner determines whether there is a stable value prestored in the storage unit 192 (352). Upon determining that the stable value is prestored in the storage unit 192, the air conditioner compares a value detected at the present time with the prestored stable value (353) to calculate a difference value and compares the calculated difference value with a predetermined reference value to determine whether the difference value is equal to or greater than the reference value (354), thereby primarily determining whether it is entry time of the defrosting operation.

Upon determining that the difference value is equal to or greater than the reference value, the air conditioner primarily determines that it is entry time of the defrosting operation. Subsequently, the air conditioner determines whether the temperature of the outdoor heat exchanger is equal to or less than a predetermined temperature (355) to secondarily determine whether it is entry time of the defrosting operation.

Upon secondarily determining that it is entry time of the defrosting operation, the air conditioner performs the defrosting operation. Processes after the defrosting operation correspond to processes 346 to 350.

The air conditioner updates the stable value stored in the storage unit 192.

In addition, the air conditioner may further store a stable value detect at the present time in the storage unit 192 of the outdoor unit in addition to a plurality of latest detected stable values.

In addition, upon determining that the heating operation to be performed at the present time is an initial heating operation, the air conditioner detects states of the respective loads provided at the air conditioner using the detection units and stores detected values as stable values. The stored stable values are used as information to determine entry time of the defrosting operation.

The forced defrosting operation may be performed based on the pressure of the outdoor heat exchanger in addition to the temperature of the outdoor heat exchanger.

Hereinafter, configurations to secondarily determine the stored stable values are used as information to determine entry using at least one selected from among the temperature of the outdoor heat exchanger, the pressure of the outdoor heat exchanger, and the operation time of the compressor will be described in more detail.

(1) The air conditioner detects the temperature of the outdoor heat exchanger, compares the detected temperature of the outdoor heat exchanger with a predetermined temperature, and secondarily determines that it is the entry time of the defrosting operation when the detected temperature of the outdoor heat exchanger is equal to or less than the predetermined temperature.

The predetermined temperature is temperature to determine the entry time of the defrosting operation.

(2) The air conditioner detects the pressure of the outdoor heat exchanger, compares the detected pressure of the outdoor heat exchanger with a predetermined pressure, and secondarily determines that it is the entry time of the defrosting operation when the detected pressure of the outdoor heat exchanger is equal to or less than the predetermined pressure.

The predetermined pressure is pressure to determine the entry time of the defrosting operation.

(3) The air conditioner detects the temperature of the outdoor heat exchanger and outdoor temperature, compares the detected temperature of the outdoor heat exchanger with the detected outdoor temperature to calculate a temperature difference, compares the calculated temperature difference with a predetermined temperature difference therebetween, and determines that it is the entry time of the defrosting operation when the calculated temperature difference is equal to or greater than the predetermined temperature difference.

(4) The air conditioner compares the operation time of the compressor counted during the heating operation with a predetermined operation time and determines that it is the entry time of the defrosting operation when the counted operation time of the compressor is equal to or greater than the predetermined operation time.

The operation time of the compressor counted during the heating operation includes operation time of the compressor counted until the present time from start of the initial heating operation or operation time of the compressor counted until the present time from start of the heating operation after completion of the defrosting operation.

(5) The air conditioner detects the temperature of the outdoor heat exchanger and outdoor temperature, compares the detected temperature of the outdoor heat exchanger with the detected outdoor temperature to calculate a temperature difference therebetween, compares the calculated temperature difference with a predetermined temperature difference, compares the operation time of the compressor counted during the heating operation with a predetermined operation time when the calculated temperature difference is equal to or greater than the predetermined temperature difference, and determines that it is the entry time of the defrosting operation when the counted operation time of the compressor is equal to or greater than the predetermined operation time.

Figure 7:
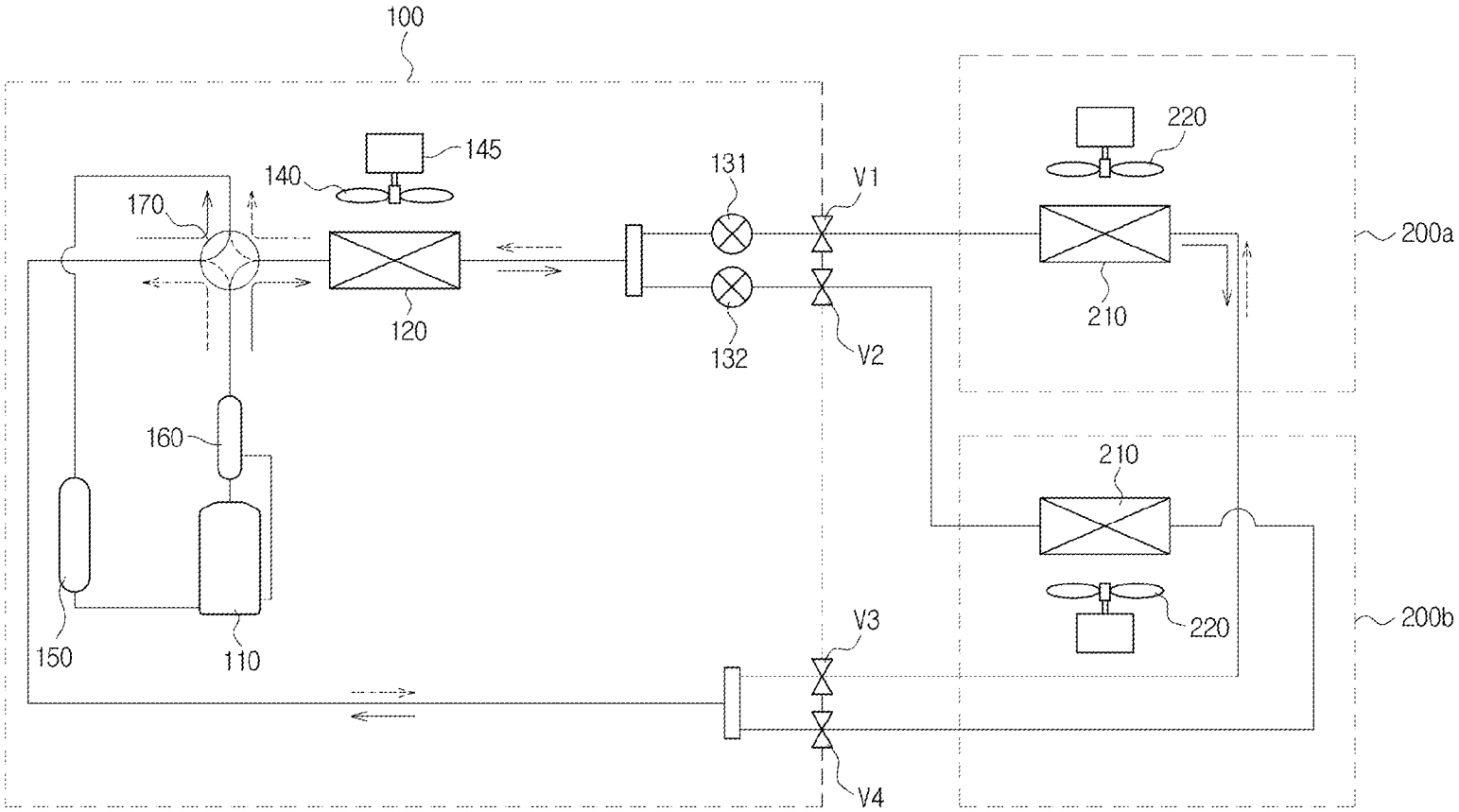
FIG. 7 is a view showing construction of an air conditioner according to another embodiment of the present disclosure.

FIG. 7 is a view showing construction of an air conditioner according to another embodiment of the present disclosure. In this embodiment, the air conditioner is a multi air conditioner including at least one outdoor unit and a plurality of indoor units.

The multi air conditioner may perform both a cooling operation to cool a room and a heating operation to heat the room.

An outdoor unit 100 includes a compressor 110, an outdoor heat exchanger 120 to exchange heat with outdoor air, a first expansion valve 131 and a second expansion valve 132 to respectively supply refrigerant supplied from the outdoor heat exchanger 120 to a first indoor unit 200*a* and a second indoor unit 200*b* via a first distribution pipe, and an outdoor fan 140 rotated by a fan motor to forcibly blow air around the outdoor heat exchanger 120 to assist heat exchange.

The first and second expansion valves 131 and 132 are flow control valves, opening of which is controlled to adjust flow rate of the refrigerant supplied to the first indoor unit and the second indoor unit.

The outdoor unit 100 further includes a second distribution pipe to supply refrigerant supplied from the first indoor unit 200*a* and the second indoor unit 200*b* to the compressor 110.

Distributers having valves may be used instead of the first distribution pipe and the second distribution pipe.

The outdoor unit 100 further includes an accumulator 150 disposed at a suction side of the compressor 110 to separate unevaporated liquefied refrigerant from the refrigerant introduced into the compressor 110 from the indoor units 200*a* and 200*b* so as to prevent the liquefied refrigerant from being discharged to the compressor 110, thereby preventing damage to the compressor 110 and an oil separator 160 to separate oil contained in steam of the refrigerant discharged from the compressor 110 and to return the separated oil to the compressor 110, thereby preventing lowering of a heat transfer effect due to oil films formed on the surface of the outdoor heat exchanger and the surfaces of indoor heat exchangers and lowering of lubrication due to lack of lubricant in the compressor 110.

A four-way valve 170 is a flow channel switching valve for switching between cooling and heating. During a heating operation, the four-way valve 170 guides high-temperature, high-pressure refrigerant discharged from the compressor 110 to the first indoor unit 200*a* and the second indoor unit 200*b* and guides low-temperature, low-pressure refrigerant from the outdoor heat exchanger 120 to the accumulator 150. At this time, the outdoor heat exchanger 120 functions as an evaporator and a first indoor heat exchanger and a second indoor heat exchanger function as condensers.

On the other hand, during a cooling operation, the four-way valve 170 guides high-temperature, high-pressure refrigerant discharged from the compressor 110 to the outdoor heat exchanger 120 and guides low-temperature, low-pressure refrigerant from the first indoor unit 200*a* and the second indoor unit 200*b* to the accumulator 150. At this time, the outdoor heat exchanger 120 functions as a condenser and the first indoor unit 200*a* and the second indoor unit 200*b* function as evaporators.

The multi air conditioner further includes connection valves v1, v2, v3, and v4 connected between a refrigerant pipe of the outdoor unit 100 and refrigerant pipes of the first and second indoor units 200*a* and 200*b*.

The first indoor unit 200*a* and the second indoor unit 200*b* cool inner spaces using a principle of evaporation and heat the inner spaces using a principle of condensation. During the heating operation, the first indoor unit 200*a* and the second indoor unit 200*b* performs defrosting operation to defrost the outdoor heat exchanger. At this time, the first indoor unit 200*a* and the second indoor unit 200*b* function as evaporators.

The first indoor unit 200*a* and the second indoor unit 200*b* are the same and are identical to the indoor unit 200 of the previous embodiment and, therefore, a description thereof will be omitted.

Figure 8:
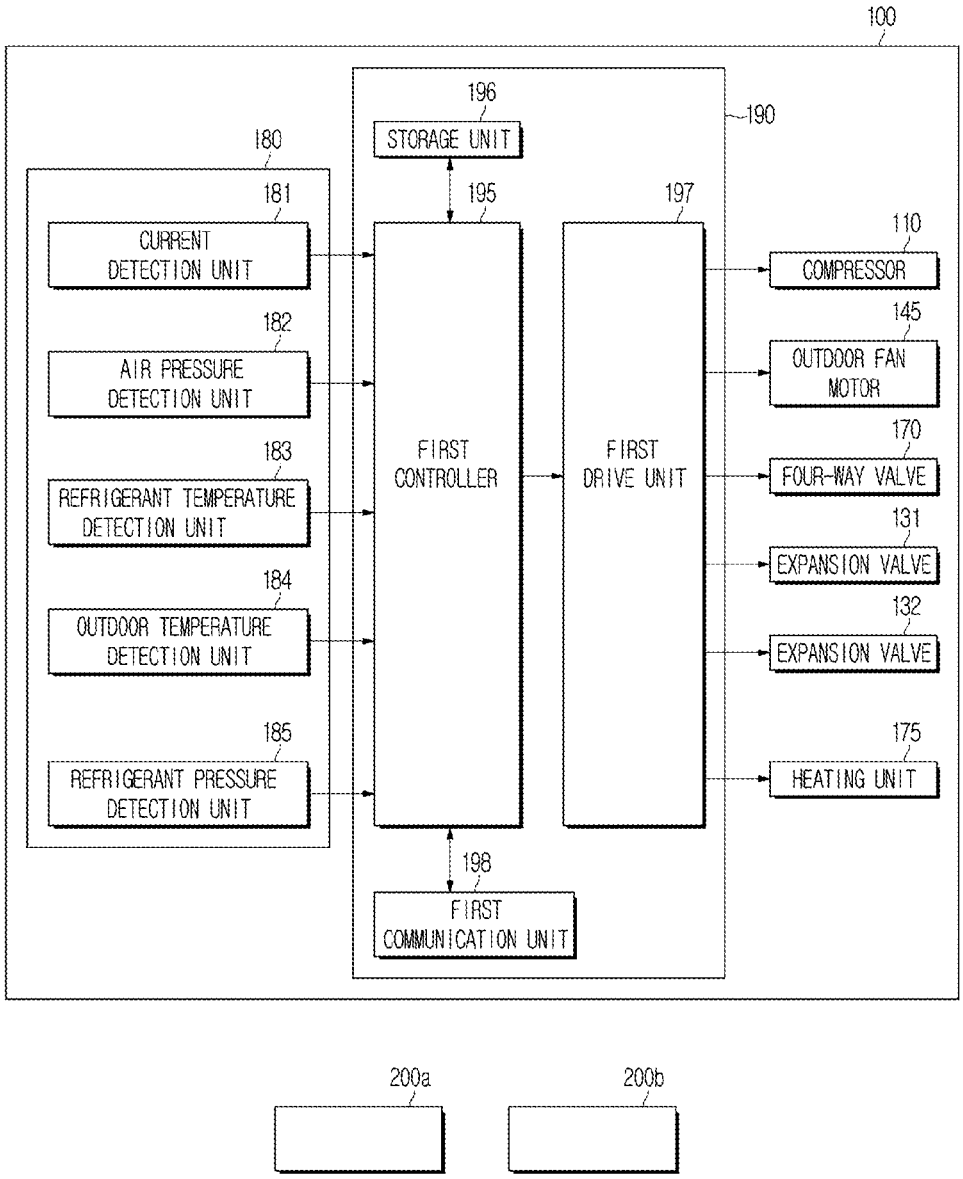
FIG. 8 is a control block diagram of the air conditioner according to the embodiment of the present disclosure.

FIG. 8 is a control block diagram of the air conditioner according to the embodiment of the present disclosure.

The outdoor unit of the multi air conditioner includes an outdoor information detection unit 180, an outdoor drive module 190, and a plurality of outdoor loads including the compressor 110, expansion valves 131 and 132, and outdoor fan motor 145. Each indoor unit includes a user interface 230, an indoor information detection unit 240, an indoor drive module 250, and an indoor load, which is the indoor fan motor 225, as shown in FIG. 2.

The outdoor information detection unit 180 and the outdoor loads including the compressor 110, expansion valves 131, 132, and outdoor fan motor 145 of the outdoor unit and the user interface 230, the indoor information detection unit 240, the indoor drive module 250, and the indoor load 220 of each indoor unit are the same as the previous embodiment and thus a description thereof will be omitted.

The outdoor drive module 190 of the outdoor unit includes a first controller 195, a storage unit 196, a first drive unit 197, and a first communication unit 198.

When an operation command from each indoor unit is input, the first controller 195 controls driving of the respective loads in the outdoor unit.

When an operation start command is input, the first controller 195 checks an operation mode and controls opening of the flow channel of the four-way valve 170 based on the checked operation mode.

When a cooling operation command is input, the first controller 195 controls opening of the flow channel of the four-way valve 170 to circulate the refrigerant and controls the compressor 110, the expansion valve 130, and the outdoor fan 140 such that the indoor space is cooled.

When a heating operation command is input, the first controller 195 controls switching of the flow channel of the four-way valve 170 to switch the flow of the refrigerant and controls the compressor 110, the expansion valves 131 and 132, and the outdoor fan 140 such that the indoor space is heated.

When the operation mode of at least one indoor unit is a heating operation, the first controller 195 determines total indoor heat load, checks target discharge pressure of the compressor corresponding to the determined total heat load, decides an operation rate of the compressor based on the checked target discharge pressure of the compressor, and controls operation of the compressor according to the decided operation rate of the compressor.

During the heating operation, the first controller 195 checks the operation rate of the compressor, compares the checked operation rate of the compressor with a predetermined operation rate to determine whether the checked operation rate of the compressor is equal to or greater than the predetermined operation rate, and determines entry time of a defrosting operation based on a prestored detected value upon determining that the checked operation rate of the compressor is equal to or greater than the predetermined operation rate.

Upon determining that it is the entry time of the defrosting operation, the first controller 195 controls switching of the flow channel of the four-way valve 170 to change a refrigerant circulation direction and controls the compressor 110, the expansion valves 131, 132, and the outdoor fan motor 145 such that the defrosting operation is performed.

The outdoor unit further includes a heating unit 175 disposed adjacent to the outdoor heat exchanger. The first controller may control driving of the heating unit 175 for the defrosting operation.

Determining the entry time of the defrosting operation based on the prestored detected value is the same as the previous example and thus a description thereof will be omitted.

The first controller 195 determines whether the defrosting operation has been completed. Upon determining that the defrosting operation has been completed, the first controller 195 controls switching of the flow channel of the four-way valve 170 and controls the compressor 110, the expansion valves 131, 132, and the outdoor fan motor 145 such that the heating operation is resumed.

During the heating operation after completion of the defrosting operation, the first controller 195 checks the operation rate of the compressor, determines whether the operation rate of the compressor is equal to or greater than the predetermined operation rate, determines that the air conditioner is in an unfrosted state, i.e. a stable state, upon determining that the operation rate of the compressor is equal to or greater than the predetermined operation rate, and detects a state of the air conditioner in the stable state.

That is, in a case in which the compressor is a variable capacity compressor, the operation rate of the compressor is maximized when the outdoor heat exchanger is defrosted to such an extent that it is necessary to enter the defrosting operation. In consideration thereof, it is designated as a stable state when the operation rate of the compressor is equal to or greater than the predetermined operation rate and the state of the air conditioner in the stable state is detected.

In addition, the first controller 195 detects a state of the air conditioner when it is determined that the operation rate of the compressor is equal to or greater than the predetermined operation rate.

For a multi air conditioner including a plurality of indoor units, the stable mode may be changed depending upon the operation mode of each indoor unit. In consideration thereof, the unfrosted state, i.e. the stable state, may be determined based on the operation rate of the compressor, thereby preventing distortion in determining the entry time of the defrosting operation.

In addition, during the heating operation after completion of the defrosting operation, the first controller 195 may check the number of rotations of the outdoor fan, determine whether the number of rotations of the outdoor fan is equal to or greater than a predetermined number of rotations, and determine upon determining that the air conditioner is in the unfrosted state, i.e. the stable state, the number of rotations of the outdoor fan is equal to or greater than the predetermined number of rotations.

That is, the stable state is determined when the number of rotations of the outdoor fan is equal to or greater than the predetermined number of rotations considering the fact that the outdoor fan is rotated at the maximum number of rotations in a state in which the outdoor heat exchanger is frosted.

A stable value is the same as the previous example and thus a description thereof will be omitted.

Unlike the previous embodiment, the storage unit 196 further stores the predetermined operation rate of the compressor used to determine the entry time of the defrosting operation.

The predetermined operation rate of the compressor is about 70% or more the maximum operation rate of the compressor.

The first drive unit 197 and the first communication unit 198 are identical to the previous example and thus a description thereof will be omitted.

Figure 9:
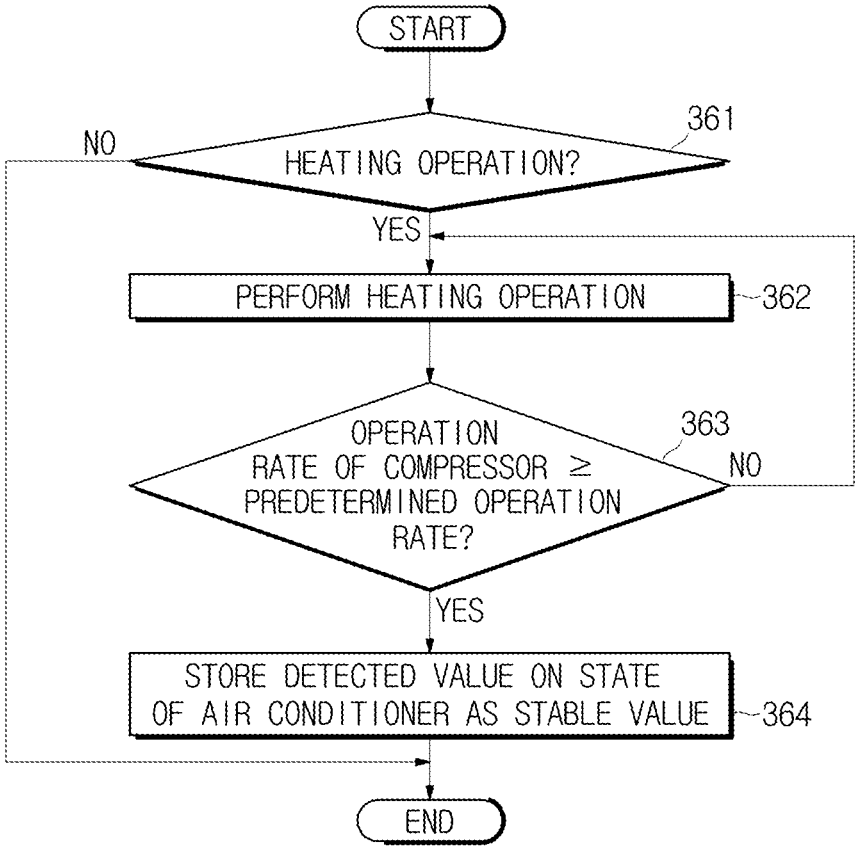
FIG. 9 is a control flowchart of the air conditioner according to the embodiment of the present disclosure.

FIG. 9 is a control flowchart of the air conditioner according to the embodiment of the present disclosure.

The air conditioner determines whether an operation start command has been input through the input unit of the indoor unit or the remote controller. Upon determining that the operation start command has been input, the air conditioner checks an input operation mode.

The air conditioner determines whether the checked operation mode is a heating operation (361). Upon determining that the checked operation mode is not the heating operation, the air conditioner controls the flow channel of the four-way valve 170 and drives the compressor 110 such that refrigerant compressed by the compressor 110 is discharged to the outdoor heat exchanger to perform a cooling operation.

On the other hand, upon determining that the checked operation mode is the heating operation, the air conditioner controls the flow channel of the four-way valve 170 and drives the compressor 110 such that the refrigerant compressed by the compressor 110 is discharged to the indoor heat exchanger to perform the heating operation (362). During the heating operation, the air conditioner checks an operation rate of the compressor and determines whether the checked operation rate of the compressor is equal to or greater than a predetermined operation rate.

Upon determining that the checked operation rate of the compressor is equal to or greater than the predetermined operation rate, the air conditioner primarily determines whether it is entry time of a defrosting operation using a stable value stored in the storage unit.

Primary determination as to whether it is entry time of a defrosting operation includes calculating a difference value between the stable value prestored in the storage unit and a value detected at the present time and comparing the calculated difference value with a reference value to determine whether the difference value is equal to or greater than the reference value.

For example, when determining the entry time of the defrosting operation using temperature of the outdoor heat exchanger, the air conditioner compares a temperature value of the outdoor heat exchanger detected at the present time with the prestored temperature value of the outdoor heat exchanger to calculate a difference value and compares the calculated difference value with a reference value to determine whether the difference value is equal to or greater than the reference value.

On the other hand, when determining the entry time of the defrosting operation using temperature of the indoor heat exchanger, the air conditioner compares a temperature value of the indoor heat exchanger detected at the present time with the prestored temperature value of the indoor heat exchanger to calculate a difference value and compares the calculated difference value with a reference value to determine whether the difference value is equal to or greater than the reference value.

The temperature of the indoor heat exchanger is the maximum temperature, the minimum temperature, or the average temperature of the indoor heat exchanger of the indoor unit during the heating operation.

The stable value prestored in the storage unit 196 is a value detected in the stable state, i.e. when the operation rate of the compressor is equal to or greater than the predetermined operation rate during heating operation after completion of the previous defrosting operation.

In addition, the air conditioner may extract a plurality of prestored stable values, calculate an average value of the extracted stable values, calculate a difference value between the calculated average value and a value detected at the present time, and compare the calculated difference value with a reference value to determine whether the calculated difference value is equal to or greater than the reference value.

Upon primarily determining that it is the entry time of the defrosting operation, the air conditioner secondarily determines the entry time of the defrosting operation based on the present state of the outdoor unit.

Upon secondarily determining that it is the entry time of the defrosting operation, the air conditioner switches the flow channel of the four-way valve 170 such that the refrigerant compressed by the compressor 110 is discharged to the indoor heat exchanger 210 to perform the defrosting operation.

That is, flow of the refrigerant during the defrosting operation is equal to that during the cooling operation.

As a result, high-temperature refrigerant flows in the outdoor heat exchanger and thus the outdoor heat exchanger may be defrosted.

In addition, the air conditioner may drive the heating unit disposed adjacent to the outdoor heat exchanger during the defrosting operation.

Subsequently, the air conditioner determines whether the defrosting operation has been completed. Upon determining that the defrosting operation has been completed, the air conditioner performs the heating operation (362). During the heating operation, the air conditioner determines whether the air conditioner is in a stable state.

Determination as the whether the air conditioner is in the stable state includes determining that the air conditioner is in the stable state when the operation rate of the compressor during the heating operation is equal to or greater than the predetermined operation rate (363).

Upon determining that the air conditioner is in the stable state, the air conditioner detects a state of the air conditioner and stores the detected value (364).

In addition, determination as the whether the air conditioner is in the stable state includes determining that the air conditioner is in the stable state when the number of rotations of the outdoor fan during the heating operation is equal to or greater than the predetermined number of rotations.

Figure 10:
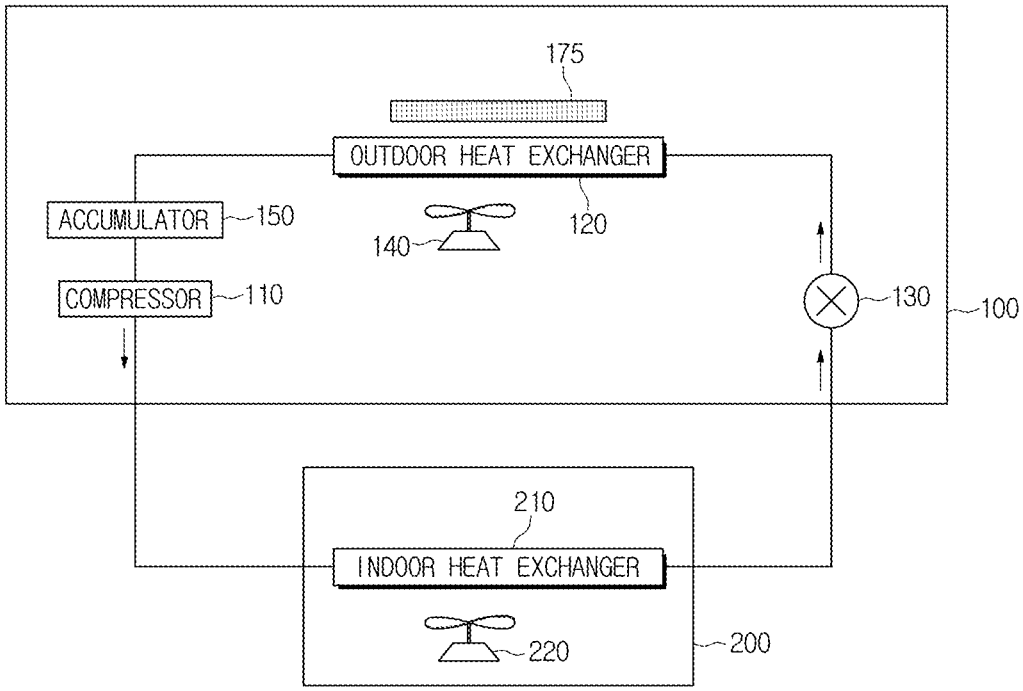
FIG. 10 is a view showing construction of an air conditioner according to a further embodiment of the present disclosure.

FIG. 10 is a view showing construction of an air conditioner according to a further embodiment of the present disclosure. In this embodiment, the air conditioner is a single air conditioner functioning as a heat pump that performs a heating operation to heat a room.

The single air conditioner includes an outdoor unit 100 and an indoor unit 200.

The outdoor unit 100 includes a compressor 110, an outdoor heat exchanger 120, an expansion valve 130, an outdoor fan 140, and an accumulator 150. The indoor unit 200 includes an indoor heat exchanger 210 and an indoor fan 220. Between the outdoor unit 100 and the indoor unit 200 is connected a refrigerant pipe, along which refrigerant circulates.

During the heating operation, the outdoor heat exchanger 120 functions as an evaporator and the indoor heat exchanger 210 functions as a condenser.

The compressor 110 compresses refrigerant and discharges the compressed refrigerant, i.e. high-temperature, high-pressure gaseous refrigerant, into the indoor heat exchanger 210.

The outdoor heat exchanger 120 is disposed in an outdoor space. The outdoor heat exchanger 120 exchanges heat with outdoor air through heat absorption caused by evaporation of the refrigerant introduced from the expansion valve 130. At this time, low-temperature, low-pressure liquefied refrigerant is changed into low-temperature, low-pressure gaseous refrigerant.

The expansion valve 130 is disposed between the outdoor heat exchanger 120 and the indoor heat exchanger 210. One side of the expansion valve 130 is connected to the outlet side of the indoor heat exchanger 210 and the other side of the expansion valve 130 is connected to the inlet side of the outdoor heat exchanger 120. A capillary tube may be used as the expansion valve 130.

The expansion valve 130 reduces pressure and temperature of the refrigerant introduced from the indoor heat exchanger 210 such that heat is easily absorbed due to evaporation of the refrigerant and transmits the refrigerant to the outdoor heat exchanger 120.

The outdoor fan 140 is provided at one side of the outdoor heat exchanger 120. The outdoor fan 140 is rotated by a motor to accelerate heat absorption of the refrigerant.

The accumulator 150 is disposed at the suction side of the compressor 110. The accumulator 150 separates unevaporated liquefied refrigerant from the refrigerant moving from the outdoor heat exchanger 120 to the compressor 110 to prevent the liquefied refrigerant from being transmitted to the compressor 110, thereby preventing damage to the compressor 110.

The indoor heat exchanger 210 is connected to the discharge port of the compressor 110 via the refrigerant pipe. The indoor heat exchanger 210 condenses the refrigerant introduced from the compressor 110 through heat radiation from the refrigerant. At this time, the high-temperature, high-pressure gaseous refrigerant is changed into high-temperature, high-pressure liquefied refrigerant.

The indoor fan 220 is disposed at one side of the indoor heat exchanger 210. The indoor fan 220 is rotated by a motor to forcibly blow the heat-exchanged air into an indoor space.

A plurality of refrigerant pipes may be provided. The refrigerant pipes are connected between the compressor 110 and the outdoor heat exchanger 120, between the outdoor heat exchanger 120 and the expansion valve 130, between the expansion valve 130 and the indoor heat exchanger 210, and between the indoor heat exchanger 210 and the compressor 110.

The air conditioner further includes a detection unit to detect information corresponding to states of loads, such as the compressor, the indoor unit, and the outdoor unit.

The detection unit includes at least one selected from among a refrigerant pressure detection unit to detect the pressure of the refrigerant at the suction side or the discharge side of the compressor, a refrigerant temperature detection unit to detect the temperature of the refrigerant at the inlet and outlet of the outdoor heat exchanger and the temperature of the refrigerant at the inlet and outlet of the indoor heat exchanger, an air pressure detection unit to detect the pressure of air at the inlet and outlet of the outdoor fan, and a current detection unit to detect current flowing in the motor of the outdoor fan.

The detection unit may further include an outdoor temperature detection unit to detect outdoor temperature and an indoor temperature detection unit to detect indoor temperature.

During the heating operation, the outdoor unit determines entry time of a defrosting operation. Upon determining that it is the entry time of the defrosting operation, the outdoor unit drives a heating unit 175 to perform the defrosting operation.

Determining the entry time of the defrosting operation is the same as the previous example and thus a description thereof will be omitted.

When the defrosting operation is completed, the outdoor unit determines whether the air conditioner is in a stable state. Upon determining that the air conditioner is in the stable state, the outdoor unit detects a state of the air conditioner and stores the detected value as a stable value to determine entry time of the next defrosting operation.

Determination as to whether the air conditioner is in the stable state is the same as the previous example and thus a description thereof will be omitted.

As is apparent from the above description, according to embodiments of the present disclosure, entry time of a defrosting operation, which is a cooling operation performed during a heating operation, is accurately determined, thereby minimizing the number of times of the defrosting operation during the heating operation.

That is, the defrosting operation is prevented from being unnecessary performed.

Consequently, interruption of the heating operation due to the defrosting operation is minimized, thereby improving heating performance and thus user comfort. Furthermore, noise generated from the indoor unit due to the defrosting operation is minimized.

In addition, when the heater is driven during the defrosting operation, the defrosting operation is prevented from being unnecessary performed, thereby reducing power consumption during the defrosting operation.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A control method of an air conditioner, having an outdoor unit and at least one indoor unit, to perform a heating operation and a defrosting operation, the control method comprising:

determining entry time of the defrosting operation during the heating operation;

upon determining that it is the entry time of the defrosting operation, performing the defrosting operation;

upon determining that the defrosting operation has been completed, determining a stable state of the air conditioner, the stable state being a state in which the outdoor unit is unfrosted; and upon determining that the air conditioner is in the stable state, storing a value detected in the stable state as a stable value to determine entry time of a next defrosting operation, wherein the determining the stable state comprises checking an operation rate of a compressor provided at the outdoor unit;

determining whether the checked operation rate of the compressor is equal to or greater than a predetermined operation rate; and upon determining that the operation rate of the compressor is equal to or greater than the predetermined operation rate, determining that the air conditioner is in the stable state.

2. The control method according to claim 1, wherein the determining the entry time of the defrosting operation comprises:

detecting a state of at least one selected between the outdoor unit and the indoor unit during the heating operation;

comparing the detected value with a stable value prestored in a storage unit to calculate a difference value therebetween;

comparing the calculated difference value with a reference value to determine whether the difference value is equal to or greater than the reference value; and upon determining that the difference value is equal to or greater than the reference value, determining that it is the entry time of the defrosting operation.

3. The control method according to claim 1, wherein the determining the stable state comprises determining the stable state within a predetermined time from start of the heating operation immediately after completion of the defrosting operation.

4. A control method of an air conditioner, having an outdoor unit and at least one indoor unit, to perform a heating operation and a defrosting operation, the control method comprising:

determining entry time of the defrosting operation during the heating operation;

upon determining that it is the entry time of the defrosting operation, performing the defrosting operation;

upon determining that the defrosting operation has been completed, determining a stable state of the air conditioner, the stable state being a state in which the outdoor unit is unfrosted; and upon determining that the air conditioner is in the stable state, storing a value detected in the stable state as a stable value to determine entry time of a next defrosting operation, wherein the determining the stable state comprises checking a number of rotations of an outdoor fan provided at the outdoor unit;

determining whether the checked number of rotations is equal to or greater than a predetermined number of rotations; and upon determining that the checked number of rotations is equal to or greater than the predetermined number of rotations, determining that the air conditioner is in the stable state.

5. The control method according to claim 1, wherein the detected value comprises at least one selected from among a temperature value of an outdoor heat exchanger provided at the outdoor unit, a current value applied to a motor of an outdoor fan, a difference value in air pressure between an inlet and an outlet of the outdoor fan, a temperature value of an indoor heat exchanger provided at the indoor unit, an evaporation pressure value, and a condensation pressure value.

6. The control method according to claim 1, further comprising, when the value detected in the stable state is input, further storing the input detected value as a stable value.

7. The control method according to claim 1, further comprising, when the value detected in the stable state is input, deleting an earliest one of stable values prestored in a storage unit and storing the input detected value in the storage unit as a stable value.

8. The control method according to claim 7, wherein the determining the entry time of the defrosting operation comprises:

extracting a plurality of latest stored stable values from a present time from the storage unit;

calculating an average value of the extracted stable values;

comparing the value detected at the present time with the calculated average value to calculate a difference value therebetween; and comparing the calculated difference value with a reference value to determine whether the difference value is equal to or greater than the reference value.

9. The control method according to claim 7, wherein the determining the entry time of the defrosting operation comprises:

extracting a plurality of latest stored stable values from a present time from the storage unit;

applying weight to the extracted stable values such that largest weight is applied to a latest one of the extracted stable values while smallest weight is applied to an earliest one of the extracted stable values to calculate a weighted average value;

comparing the value detected at the present time with the calculated weighted average value to calculate a difference value therebetween; and comparing the calculated difference value with a reference value to determine whether the difference value is equal to or greater than the reference value.

10. The control method according to claim 1, further comprising:

upon primarily determining that it is the entry time of the defrosting operation based on the stored stable value, detecting temperature of an outdoor heat exchanger provided at the outdoor unit and comparing the detected temperature of the outdoor heat exchanger with a predetermined temperature;

checking an operation time of a compressor provided at the outdoor unit and comparing the checked operation time of a compressor with a predetermined operation time; and when at least one selected from between a condition that the temperature of the outdoor heat exchanger is equal to or less than the predetermined temperature and a condition that the operation time of a compressor is equal to or greater than the predetermined operation time is satisfied, secondarily determining that it is the entry time of the defrosting operation.

11. The control method according to claim 1, further comprising:

upon primarily determining that it is the entry time of the defrosting operation based on the stored stable value, comparing pressure of an outdoor heat exchanger provided at the outdoor unit with a predetermined pressure; and upon determining that the pressure of the outdoor heat exchanger is equal to or less than the predetermined pressure, secondarily determining that it is the entry time of the defrosting operation.

12. The control method according to claim 1, further comprising:

checking an operation time of a compressor provided at the outdoor unit; and forcibly controlling the defrosting operation when the checked operation time is equal to or greater than a predetermined forced defrosting time.

13. The control method according to claim 1, further comprising:

checking temperature of an outdoor heat exchanger provided at the outdoor unit; and forcibly controlling the defrosting operation when the checked temperature is a predetermined forced defrosting temperature.

* * * * *